US009113771B2

(12) United States Patent
Zach et al.

(10) Patent No.: US 9,113,771 B2
(45) Date of Patent: Aug. 25, 2015

(54) CLEANING SYSTEM WITH ATTACHABLE DISPENSER

(75) Inventors: Steven A. Zach, Waterford, WI (US); Julie L. Bates, Franklin, WI (US); Laura Herzog, Deerfield, IL (US); Douglas F. Stewart, San Francisco, CA (US); John E. Kiechel, Oakland, CA (US); Nasahn A. Sheppard, Mill Valley, CA (US); Christina D. Tapp, San Francisco, CA (US); Peter I. Capraro, San Francisco, CA (US); Sean P. Murphy, San Francisco, CA (US)

(73) Assignee: S. C. Johnson & Son, Inc., Racine, WI (US)

( * ) Notice: Subject to any disclaimer, the term of this patent is extended or adjusted under 35 U.S.C. 154(b) by 611 days.

(21) Appl. No.: 13/531,027

(22) Filed: Jun. 22, 2012

(65) Prior Publication Data

US 2012/0324662 A1 Dec. 27, 2012

Related U.S. Application Data

(60) Provisional application No. 61/501,028, filed on Jun. 24, 2011.

(51) Int. Cl.

| | |
|---|---|
| ***A47L 13/512*** | (2006.01) |
| ***A47L 13/22*** | (2006.01) |
| ***B05B 15/06*** | (2006.01) |

(52) U.S. Cl.

CPC ..... *A47L 13/22* (2013.01); *A47L 13/512* (2013.01); *B05B 15/061* (2013.01)

(58) Field of Classification Search

CPC combination set(s) only.

See application file for complete search history.

(56) References Cited

U.S. PATENT DOCUMENTS

| | | | | |
|---|---|---|---|---|
| 1,091,888 | A | | 3/1914 | Lorzing |
| 1,264,707 | A | * | 4/1918 | Stewart ..... 401/140 |
| 2,073,170 | A | | 3/1937 | Pieper |
| 2,187,671 | A | | 1/1940 | Suddarth |
| 2,655,680 | A | | 10/1953 | Geerin |
| 2,990,979 | A | * | 7/1961 | Harrison et al. ..... 222/482 |
| 3,148,403 | A | * | 9/1964 | Hershberger et al. ..... 401/263 |
| 3,600,100 | A | * | 8/1971 | Arones ..... 401/138 |
| 3,820,905 | A | | 6/1974 | Sims |
| 4,119,386 | A | | 10/1978 | Cushing |
| 4,432,472 | A | | 2/1984 | Lamm |
| 4,676,287 | A | | 6/1987 | Fitzwater |
| 5,299,720 | A | | 4/1994 | Koch, III |
| D356,542 | S | | 3/1995 | Finkiewicz et al. |
| 5,839,709 | A | | 11/1998 | Leonard |
| 5,862,948 | A | | 1/1999 | Duchon et al. |
| 5,954,240 | A | | 9/1999 | Duchon et al. |
| 6,217,244 | B1 | | 4/2001 | Chen et al. |
| 6,540,424 | B1 | | 4/2003 | Hall et al. |
| 6,551,001 | B2 | | 4/2003 | Aberegg et al. |
| 6,659,670 | B1 | | 12/2003 | Blouse |
| 6,663,306 | B2 | | 12/2003 | Policicchio et al. |
| 6,669,391 | B2 | | 12/2003 | Policicchio et al. |

(Continued)

*Primary Examiner* — David Walczak

(57) ABSTRACT

A cleaning system includes a cleaning implement having a handle and an attachable fluid dispenser that can be secured to the handle of the cleaning implement. A support can be located on the handle, and the support has a section that extends away from the handle. The attachable dispenser includes a container connected to a body having a dispensing mechanism for delivering a fluid from the container and out of a discharge orifice of the body. The container has an inwardly directed recess dimensioned to matingly engage the section of the support when the attachable dispenser is attached to the handle.

19 Claims, 28 Drawing Sheets

(56) References Cited

U.S. PATENT DOCUMENTS

| | | | |
|---|---|---|---|
| 6,726,388 | B1 | 4/2004 | Monahan |
| 6,953,299 | B2 | 10/2005 | Wang et al. |
| 6,957,750 | B1 | 10/2005 | Trudell |
| 6,986,618 | B2 | 1/2006 | Hall et al. |
| 7,004,663 | B1 | 2/2006 | Cupidon-Ebanks |
| 7,007,338 | B2 | 3/2006 | Garabedian, Jr. et al. |
| 7,128,490 | B2 | 10/2006 | McEwan |
| 7,163,349 | B2 | 1/2007 | Policicchio et al. |
| 7,182,537 | B2 | 2/2007 | Policicchio et al. |
| 7,481,594 | B2 | 1/2009 | Martin |
| 7,708,484 | B2 | 5/2010 | Tanaka et al. |
| 7,708,485 | B2 | 5/2010 | Tanaka et al. |
| 2003/0209263 | A1 | 11/2003 | Bell et al. |
| 2004/0028458 | A1 | 2/2004 | Heathcock et al. |
| 2006/0213920 | A1 | 9/2006 | Agarwal et al. |
| 2006/0237475 | A1 | 10/2006 | Agarwal |
| 2007/0209133 | A1 | 9/2007 | Linzell |
| 2009/0050640 | A1 | 2/2009 | Li et al. |

* cited by examiner

CLEANING SYSTEM WITH ATTACHABLE DISPENSER

CROSS-REFERENCES TO RELATED APPLICATIONS

This application claims priority from U.S. Patent Application No. 61/501,028 filed Jun. 24, 2011.

STATEMENT REGARDING FEDERALLY SPONSORED RESEARCH

Not Applicable.

BACKGROUND OF THE INVENTION

1. Field of the Invention

This invention relates to a cleaning system including a cleaning implement having a handle and a fluid dispenser that can be removably attached to the handle of the cleaning implement. When a user wishes to spray fluid from the fluid dispenser onto a surface being cleaned, the user can remove the attachable dispenser from the handle. After spraying fluid onto the surface being cleaned, the attachable dispenser can be reattached to the handle of the cleaning implement.

2. Description of the Related Art

One common floor cleaning system includes a rigid, elongated handle having a proximal end and a distal end. A hand grip is often provided at the proximal end of the handle, while a mop head is typically attached at the distal end of the handle. Typically, mop heads have a removable sponge or other type absorbent pad. In one common use, the mop head is dipped into a bucket containing a cleaning formula and the pad is moved over a floor to clean the floor. This process necessitates the use of a separate bucket.

What is needed therefore is a hand-held cleaning system with an on-board, disposable, rechargeable and/or replaceable fluid dispenser that can apply a cleaning fluid to a surface being cleaned.

SUMMARY OF THE INVENTION

The foregoing needs can be met with a cleaning system according to the present invention. The cleaning system includes a cleaning implement having a handle and a fluid dispenser that can be removably attached to the handle of the cleaning implement.

In one aspect, the invention provides a cleaning system comprising a cleaning implement and an attachable dispenser. The cleaning implement includes a handle and a support located on the handle, and the support has a section that is spaced away from the handle. The attachable dispenser includes a container connected to a body having a dispensing mechanism for delivering a fluid from the container and out of a discharge orifice of the body. The body has a projection dimensioned to engage the section of the support when the attachable dispenser is attached to the handle.

In one form, the projection is located at an end portion of the body adjacent the discharge orifice of the body. In another form, the projection is located at an end portion of the body opposite the discharge orifice of the body. In another form, the projection is located on a nozzle cap of the body. In another form, the projection is a nozzle cap of the body. The nozzle cap may have an inwardly directed recess dimensioned to matingly engage an edge of a slot of the section of the support when the attachable dispenser is attached to the handle. In another form, the projection is a trigger of the dispensing mechanism. The trigger can have an opening dimensioned to surround the section of the support when the attachable dispenser is attached to the handle. In another form, the projection is located on a closure for connecting the container and the body. In another form, the projection defines an opening in the body, and the opening is dimensioned to surround the section of the support when the attachable dispenser is attached to the handle.

In another aspect, the invention provides a cleaning system comprising a cleaning implement and an attachable dispenser. The cleaning implement includes a handle and a support located on the handle wherein the support has a section that extends away from the handle. The attachable dispenser includes a container connected to a body having a dispensing mechanism for delivering a fluid from the container and out of a discharge orifice of the body. The container has an inwardly directed recess dimensioned to matingly engage the section of the support when the attachable dispenser is attached to the handle.

In one form, the section of the support is arcuate, and the recess of the container is arcuate.

In one form, the recess is part of a bottom wall of the container.

In one form, a side wall of the container has an indentation dimensioned to engage the handle adjacent the support.

In one form, the cleaning implement further comprises a second support located on the handle, the second support has a portion that extends away from the handle, and the body has a projection dimensioned to engage the portion of the second support when the attachable dispenser is attached to the handle.

In one form, the projection is located at an end portion of the body adjacent the discharge orifice of the body.

In one form, the projection is located at an end portion of the body opposite the discharge orifice of the body.

In one form, the projection is located on a nozzle cap of the body.

In one form, a spring biases one of the first support and the second support toward the other of the first support and the second support.

In another aspect, the invention provides a cleaning system comprising a cleaning implement and an attachable dispenser. The cleaning implement includes a handle and a support located on the handle, and the support has a section that is spaced away from the handle. The attachable dispenser includes a container connected to a body having a dispensing mechanism for delivering a fluid from the container and out of a discharge orifice of the body. A side wall of the container has an indentation dimensioned to engage the handle when the attachable dispenser is attached to the handle, and the body is dimensioned to engage the section of the support when the attachable dispenser is attached to the handle. In one form, the container has an inwardly directed recess dimensioned to matingly engage a section of a second support when the attachable dispenser is attached to the handle. In one form, the recess is part of a bottom wall of the container. In one form, a projection from the body engages the section of the support when the attachable dispenser is attached to the handle.

In another aspect, the invention provides a cleaning system comprising a cleaning implement and an attachable dispenser. The cleaning implement includes a handle and a support located on the handle wherein the support has a section that extends away from the handle. The attachable dispenser includes a container connected to a body having a dispensing mechanism for delivering a fluid from the container and out of a discharge orifice of the body. The dispenser has a trigger for operating the dispensing mechanism. A side wall of the container has an indentation dimensioned to engage the handle when the attachable dispenser is attached to the handle, and the support has a hole for receiving the trigger when the attachable dispenser is attached to the handle.

In yet another aspect, the invention provides a cleaning system comprising a cleaning implement and an attachable dispenser. The cleaning implement includes a handle, and the attachable dispenser includes a container connected to a body having a dispensing mechanism for delivering a fluid from the container and out of a discharge orifice of the body. A side wall of the container has an indentation dimensioned to engage the handle when the attachable dispenser is attached to the handle, and a side wall of the body has a recess dimensioned to engage the handle when the attachable dispenser is attached to the handle.

In still another aspect, the invention provides a cleaning system comprising a cleaning implement and an attachable dispenser. The cleaning implement includes a handle, and the attachable dispenser includes a container connected to a body having a dispensing mechanism for delivering a fluid from the container and out of a discharge orifice of the body. The attachable dispenser further includes a support connected to the attachable dispenser. A side wall of the container has an indentation dimensioned to engage the handle when the attachable dispenser is attached to the handle, and the support has a recess dimensioned to engage the handle when the attachable dispenser is attached to the handle.

In one form, the support is hinged to the container.

In one form, the support is hinged to the body.

In one form, the support is hinged to a closure of the container.

In yet another aspect, the invention provides a cleaning system comprising a cleaning implement and an attachable dispenser. The cleaning implement includes a handle and a support hinged on the handle. The attachable dispenser includes a container connected to a body having a dispensing mechanism for delivering a fluid from the container and out of a discharge orifice of the body. The support has spaced apart arms for receiving the attachable dispenser when the attachable dispenser is attached to the handle.

In still another aspect, the invention provides a cleaning system comprising a cleaning implement and an attachable dispenser. The cleaning implement includes a handle and a support located on the handle, and the support has a section that extends away from the handle. The attachable dispenser includes a container connected to a body having a dispensing mechanism for delivering a fluid from the container and out of a discharge orifice in a nozzle cap of the body. The nozzle cap has an inwardly directed recess dimensioned to matingly engage the section of the support when the attachable dispenser is attached to the handle.

In yet another aspect, the invention provides a cleaning system comprising a cleaning implement and an attachable dispenser. The cleaning implement includes a handle and a support located on the handle, and the support has a slot in a section spaced apart from the handle. The attachable dispenser includes a container connected to a body having a dispensing mechanism for delivering a fluid from the container and out of a discharge orifice in a nozzle cap of the body, and the nozzle cap has an inwardly directed recess dimensioned to matingly engage an edge of the slot of the section of the support when the attachable dispenser is attached to the handle.

In still another aspect, the invention provides a cleaning system comprising a cleaning implement and an attachable dispenser. The cleaning implement includes a handle and a support located on the handle, and the support has a section that extends away from the handle. The attachable dispenser includes a container connected to a body having a dispensing mechanism for delivering a fluid from the container and out of a discharge orifice of the body. The dispenser has a closure for connecting the container and the body, and the closure has a bracket with a pin. The support has a hole for receiving the pin when the attachable dispenser is attached to the handle.

In yet another aspect, the invention provides a cleaning system comprising a cleaning implement and an attachable dispenser. The cleaning implement includes a handle, a first support located on the handle, and a second support located on the handle. The attachable dispenser includes a container connected to a body having a dispensing mechanism for delivering a fluid from the container and out of a discharge orifice of the body, and the body is dimensioned to engage the first support and the second support when the attachable dispenser is attached to the handle. One of the first support and the second support is movable with respect to the other of the first support and the second support such that the body can be secured between the first support and the second support by contact with the first support and the second support when the attachable dispenser is attached to the handle.

In one form, the body has an inwardly directed recess dimensioned to matingly engage a section of the second support when the attachable dispenser is attached to the handle.

In still another aspect, the invention provides a cleaning system comprising a cleaning implement and an attachable dispenser. The cleaning implement includes a handle and a support located on the handle, and the support has a section that extends away from the handle. The attachable dispenser includes a container connected to a body having a dispensing mechanism for delivering a fluid from the container and out of a discharge orifice of the body, and the body has an opening dimensioned to matingly engage the section of the support when the attachable dispenser is attached to the handle.

In one form, a side wall of the container has an indentation dimensioned to matingly engage the handle.

In yet another aspect, the invention provides a cleaning system comprising a cleaning implement and an attachable dispenser. The cleaning implement includes a handle and a support located on the handle, and the support has a section that extends away from the handle. The attachable dispenser includes a container connected to a body having a dispensing mechanism for delivering a fluid from the container and out of a discharge orifice of the body. The dispensing mechanism includes a trigger, and the trigger has an opening dimensioned to surround the section of the support when the attachable dispenser is attached to the handle.

In one form, a side wall of the container has an indentation dimensioned to matingly engage the handle.

In still another aspect, the invention provides a cleaning system comprising a cleaning implement and an attachable dispenser. The cleaning implement includes a handle and a support located on the handle, and the support has a bracket that extends away from the handle. The attachable dispenser includes a container connected to a body having a dispensing mechanism for delivering a fluid from the container and out of a discharge orifice of the body. The dispensing mechanism includes a trigger, and the trigger is dimensioned to engage the bracket when the attachable dispenser is attached to the handle.

In one form, a side wall of the container has an indentation dimensioned to matingly engage the handle.

In one form, the bracket has an upwardly opening channel for receiving an end of the trigger.

In one form, the support includes spaced apart walls defining a space for receiving a nozzle cap of the body.

In one form, the bracket has an opening for receiving the trigger.

These and other features, aspects, and advantages of the present invention will become better understood upon consideration of the following detailed description and drawings and appended claims.

BRIEF DESCRIPTION OF THE DRAWINGS

Like reference numerals will be used to refer to like parts from Figure to Figure in the following description of the drawings.

DETAILED DESCRIPTION OF THE INVENTION

Figure 1:
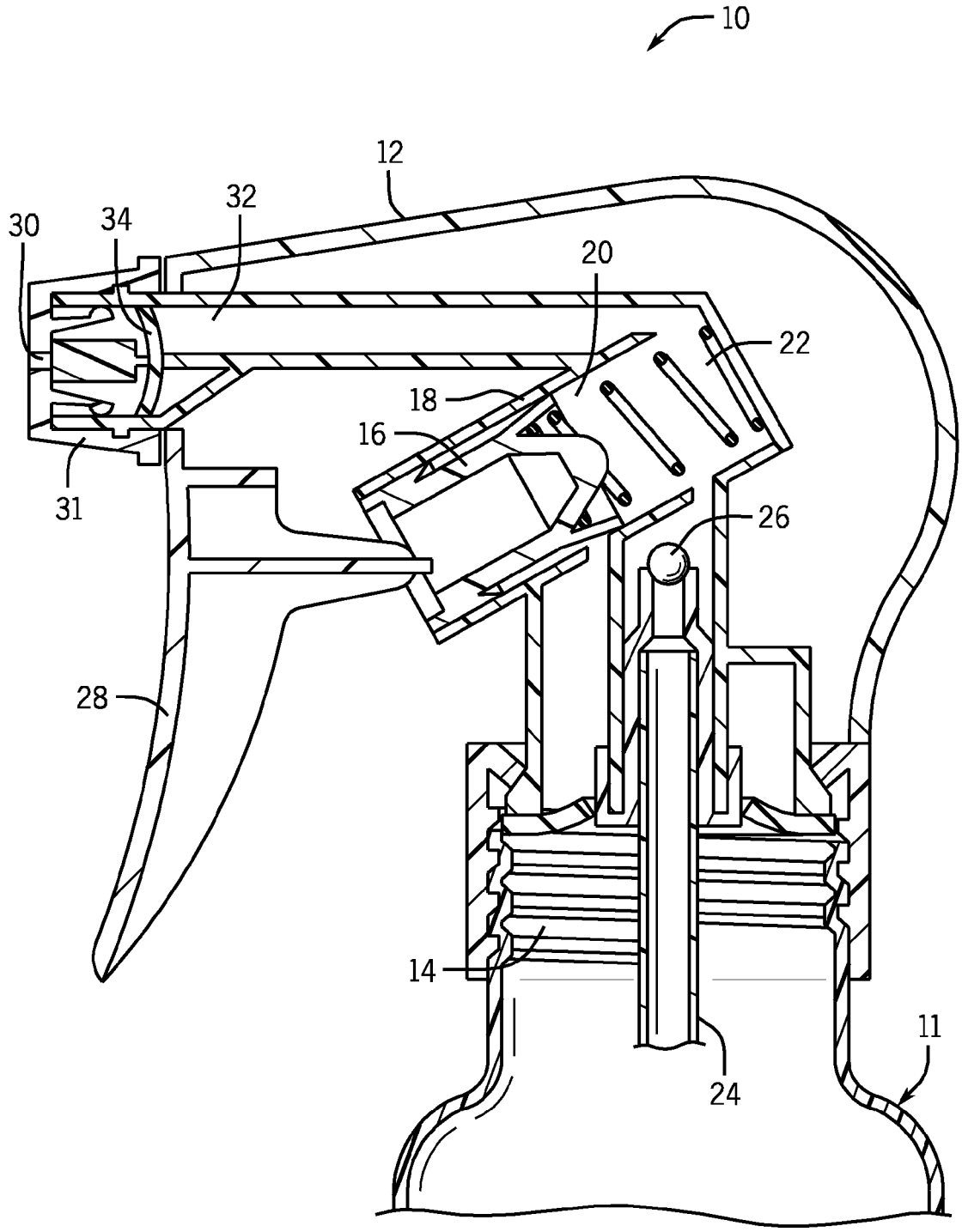
FIG. 1 PRIOR ART
FIG. 1 is a cross-sectional view of a prior art dispenser for delivering a fluid from a container.
Figure 1C:
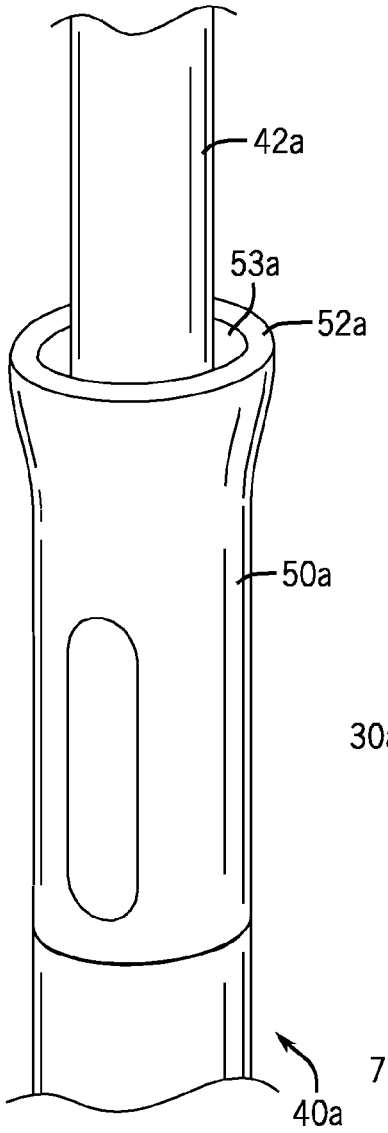
FIGS. 1A to 1H show a first embodiment of a cleaning system according to the invention with FIG. 1A being a perspective view of the dispenser of this cleaning system, FIG. 1B being a side detailed view of the dispenser of this cleaning system, FIG. 1C being a partial side view of the handle of the cleaning implement of this cleaning system, FIG. 1D being a side view of this cleaning system, FIG. 1E being a partial side view of the dispenser attached to the handle of the cleaning implement of this cleaning system, FIG. 1F being one detailed side view of the dispenser attached to a support (shown in cross-section) of the handle of the cleaning implement of this cleaning system, FIG. 1G being another detailed side view of the dispenser attached to another support (shown in cross-section) of the handle of the cleaning implement of this cleaning system, and FIG. 1H being a partial side view of the dispenser in the process of being attached to the handle of the cleaning implement of this cleaning system.
Figure 1B:
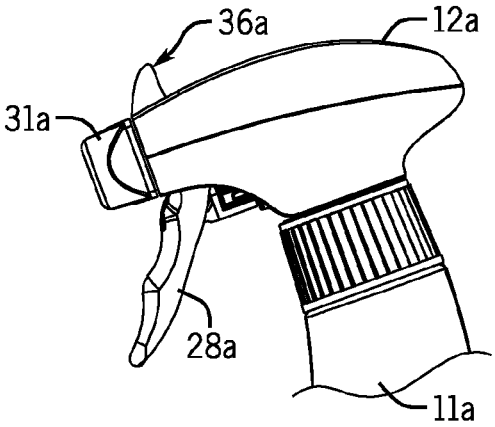
Figure 1A:
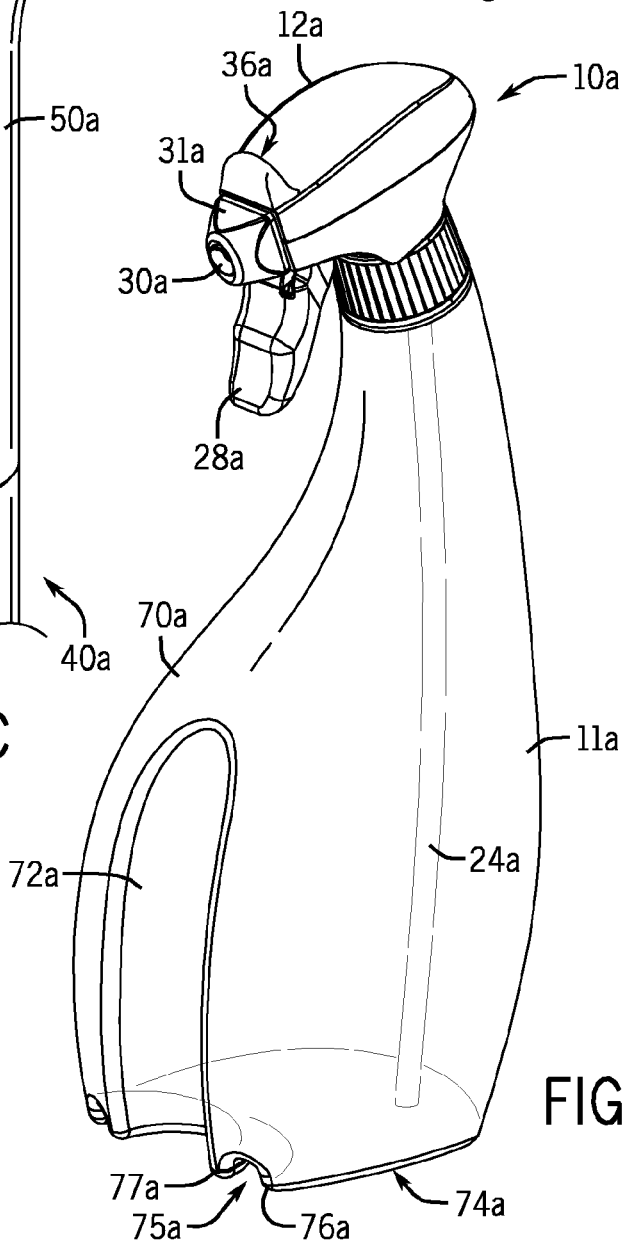

In order to provide background context for the present invention, FIG. 1 shows a prior art dispenser for delivering a fluid from a container. The dispenser 10 has a fluid container 11 and a body 12 that has connection means, such as threads 14, to connect the body 12 to the container 11. The dispenser 10 includes a dispensing mechanism held by or formed within the body 12. The dispensing mechanism is a sprayer mechanism including a piston 16 and cylinder 18 having cylinder head space 20 above the face of the piston 16. A cylindrical chamber 22 is provided that is in fluid communication with the cylinder head space 20. The dispenser 10 also includes a cylindrical dip tube 24 for transferring fluid to the chamber 22 from the container. The fluid transfer means includes a ball check valve 26 which allows fluid being transferred via the fluid transfer means to flow only toward and not away from the chamber 22.

The dispenser 10 also includes a finger operated trigger 28 for reciprocatingly moving the piston 18 within the cylinder 18, alternatingly increasing and decreasing the cylinder head space 20 to draw liquid info the chamber 22 and then expel liquid from the chamber 22. The dispenser 10 also includes a circular discharge orifice 30 in a nozzle cap 31, together with a cylindrical discharge conduit 32 that provides fluid communication between the chamber 22 and the discharge orifice 30. The discharge conduit 32 has a discharge check valve 34 that permits fluid to move toward the discharge orifice 30 and not back toward the chamber 22.

FIGS. 1A to 1G show a first example embodiment of a cleaning system 8*a* according to the invention. The cleaning system 8*a* includes an attachable dispenser 10*a* having a fluid container 11*a* and a body 12*a* that has connection means, such as threads, to connect the body 12*a* to the container 11*a*. The attachable dispenser 10*a* includes a sprayer mechanism formed within the body 12*a*. The dispenser 10*a* also includes a cylindrical dip tube 24*a* for transferring fluid to the sprayer mechanism from the container 11*a* as in the dispenser 10 of FIG. 1. The dispenser 10*a* includes a finger operated trigger 28*a* to draw liquid into the sprayer mechanism and then expel liquid from a circular discharge orifice 30*a* in a nozzle cap 31*a* as in the dispenser 10 of FIG. 1. A projection 36*a* extends upward from the body 12*a* adjacent the nozzle cap 31*a*. The fluid container 11*a* has a side wall 70*a* with an indentation 72*a*. The fluid container 11*a* has a bottom wall 74*a* having an inwardly directed arcuate recess 75*a* that terminates in an inner bottom edge 76*a* and an outer bottom edge 77*a*.

Still referring to FIGS. 1A to 1G, the cleaning system 8*a* includes a cleaning implement 40*a* having an elongated cylindrical handle 42*a* and a mop head 44*a* with a removable cleaning pad 45*a*. A tubular first support 50*a* is attached to and surrounds the handle 42*a*. The support 50*a* has a circumferential section 52*a* that extends upward and away from the handle 42*a* thereby creating an annular space 53*a* between the section 52*a* and the handle 42*a*. The section 52*a* can also extend only part of the way around the top of the support 50*a* thereby creating an arcuate section that extends upward and away from the handle 42*a*. A second support 60*a* is also attached to and surrounds the handle 42*a*. The second support 60*a* is spaced above the first support 50*a*. The second support 60*a* has a flange 62*a* that extends downward and away from the handle 42*a* thereby creating a space 63*a* between the flange 62*a* and the handle 42*a*.

Figure 1D:
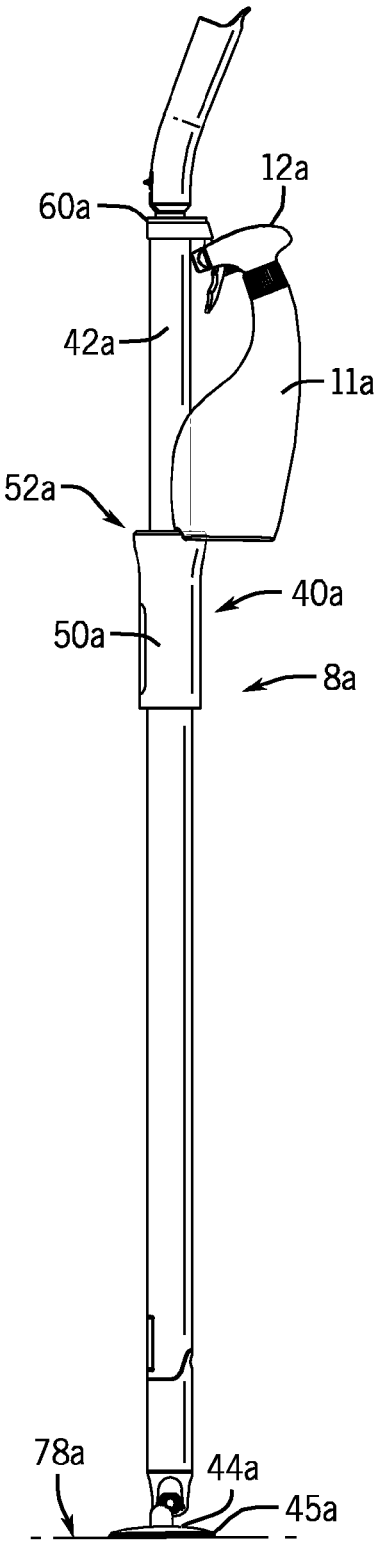
Figure 1E:
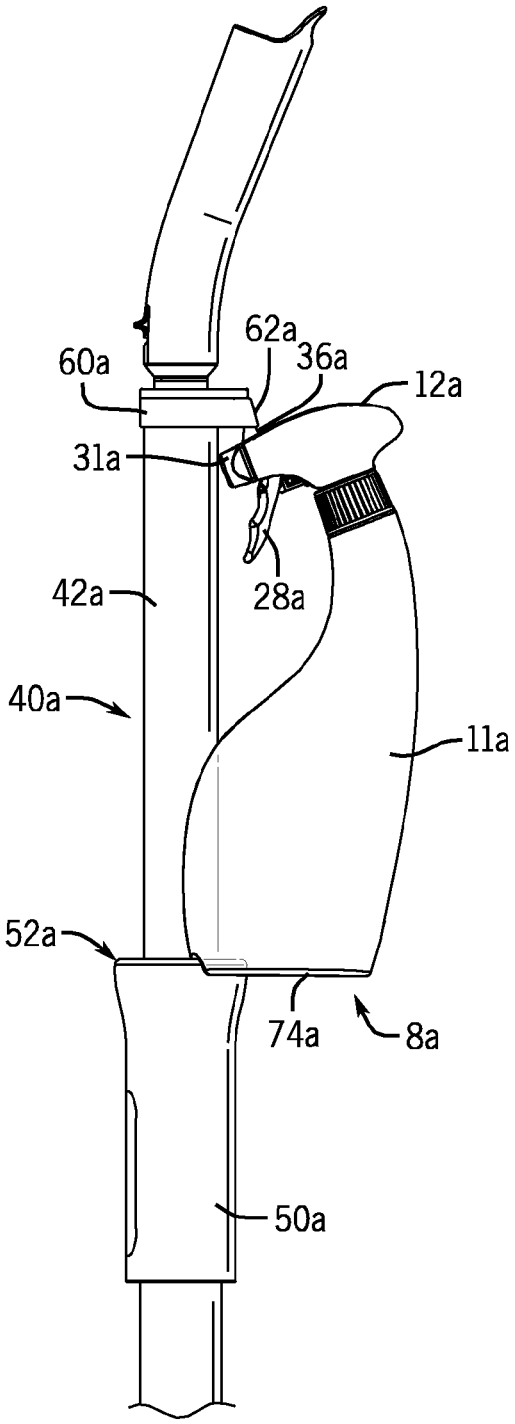
Figure 1F:
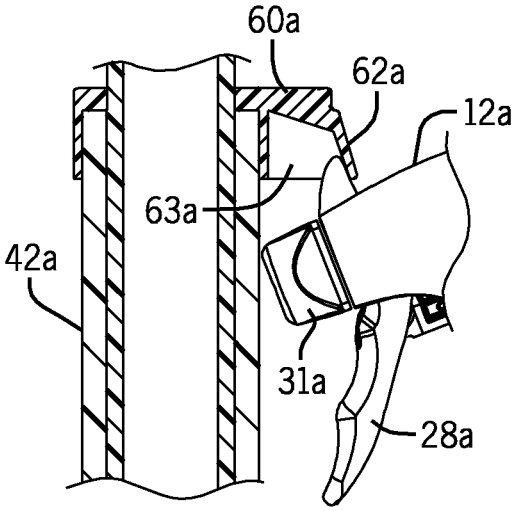
Figure 1G:
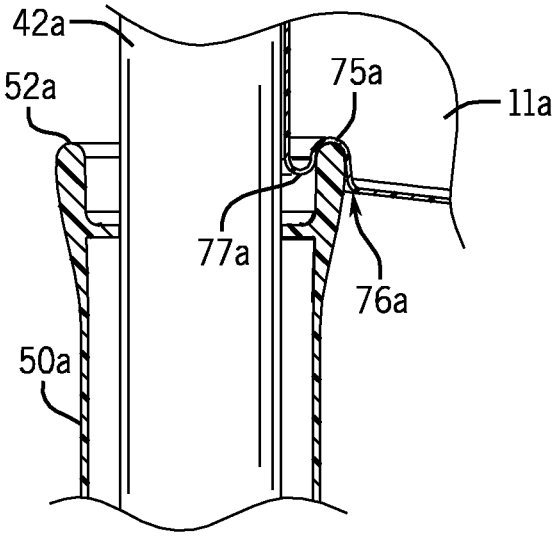
Figure 1H:
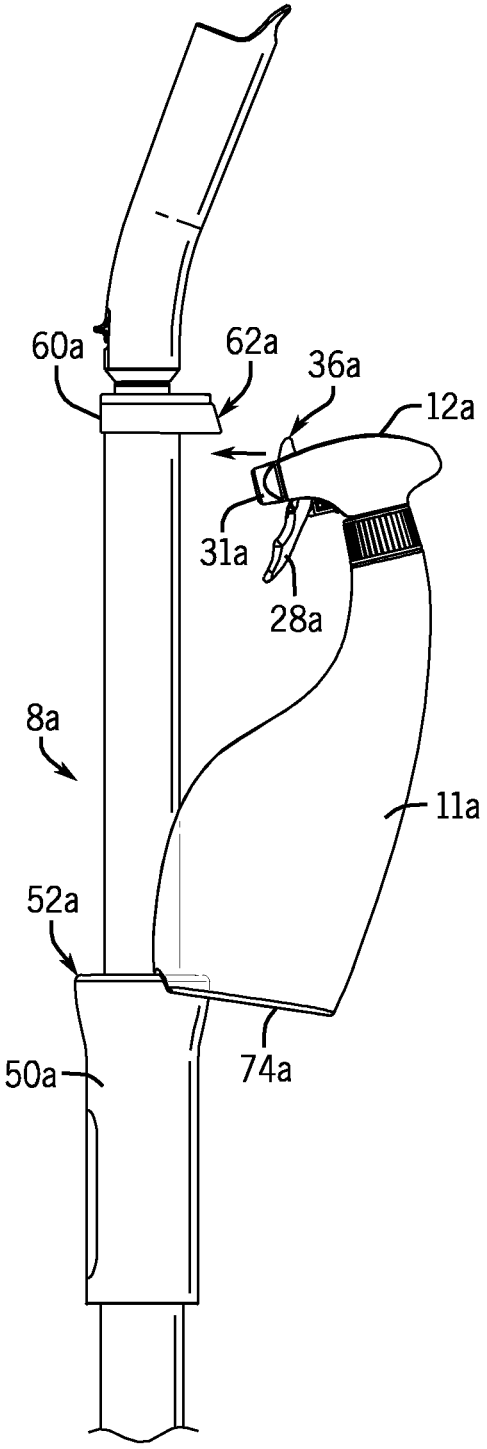

FIG. 1H shows how the attachable dispenser 10*a* of the cleaning system 8*a* is attached to the handle 42*a* of the cleaning implement 40*a*. First, the outer bottom edge 77*a* of the recess 75*a* of the fluid container 11*a* is placed in the space 53*a* between the section 52*a* and the handle 42*a* such that the section 52*a* of the first support 50*a* is located in the recess 75*a* of the fluid container 11*a* and the inner bottom edge 76*a* of the recess 75*a* is outside the section 52*a* of the first support 50*a*. The indentation 72*a* is also aligned with the handle 42*a*. The attachable dispenser 10*a* is then moved in direction 2 in FIG. 1H until the projection 36*a* of the body 12*a* snaps under the flange 62*a* of the second support 60*a* as shown in FIG. 1E. A user can then clean a floor 78*a* as shown in FIG. 1D with the attachable dispenser 10*a* securely attached to the handle 42*a* of the cleaning implement 40*a*. When an occasion arises in which the user wishes to spray fluid from the fluid container 11*a* onto the floor 78*a*, the user can pull the attachable dispenser 10*a* in a direction opposite to direction 2 in FIG. 1H such that the projection 36*a* of the body 12*a* disengages from the flange 62*a* of the second support 60*a*. After spraying fluid on the floor 78*a*, the attachable dispenser 10*a* can be reattached to the handle 42*a* as described above.

Figure 2B:
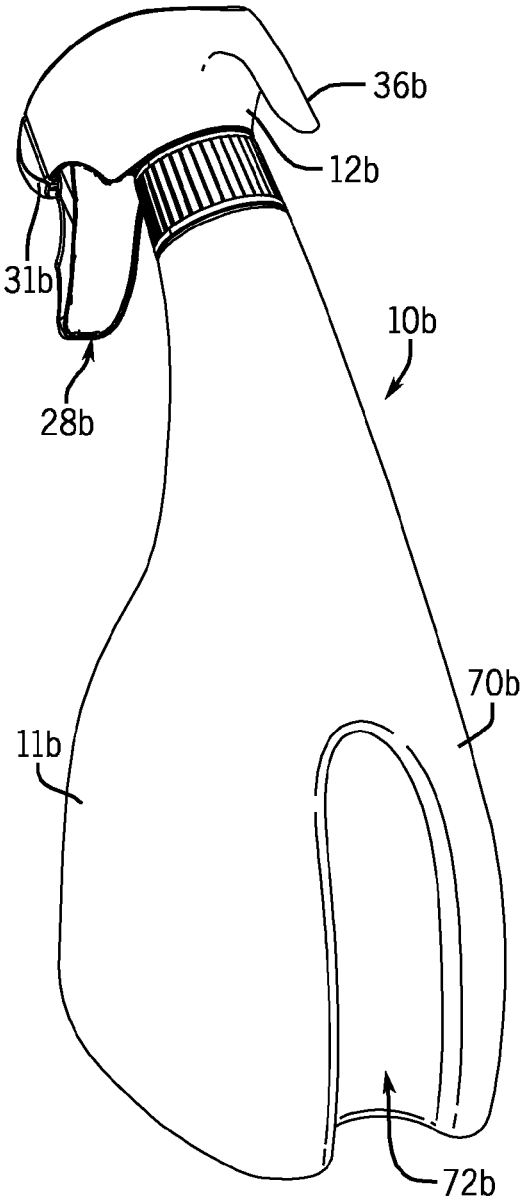
FIGS. 2A and 2B show a second embodiment of a cleaning system according to the invention with FIG. 2A being a partial side view of the dispenser attached to the handle of the cleaning implement of this cleaning system and FIG. 2B being a rear perspective view of the dispenser of this cleaning system.
Figure 2A:
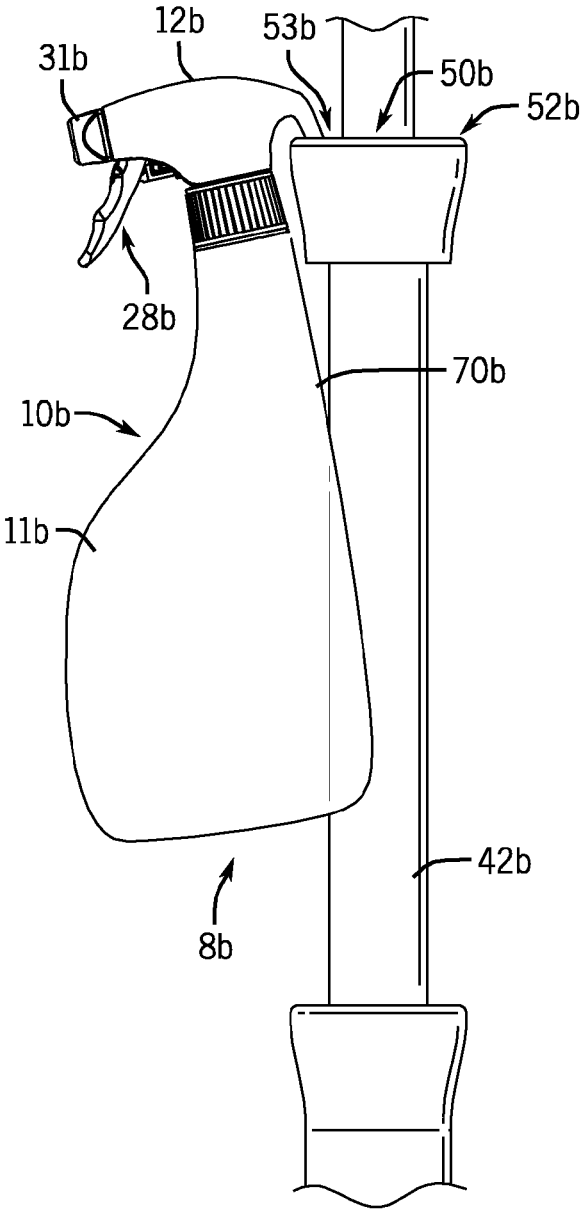

FIGS. 2A and 2B show a second example embodiment of a cleaning system 8*b* according to the invention. The cleaning system 8*b* includes an attachable dispenser 10*b* having a fluid container 11*b* and a body 12*b* that has connection means to connect the body 12*b* to the container 11*b*. The attachable dispenser 10*b* includes a sprayer mechanism formed within the body 12*b*. The dispenser 10*b* also includes a cylindrical dip tube for transferring fluid to the sprayer mechanism from the container 11*b* as in the dispenser 10 of FIG. 1. The dispenser 10*b* includes a finger operated trigger 28*b* to draw liquid into the sprayer mechanism and then expel liquid from a circular discharge orifice in a nozzle cap 31*b* as in the dispenser 10 of FIG. 1. A projection 36*b* extends downward from the body 12*b* at a rear end portion of the body 12*b* opposite the nozzle cap 31*b*. The fluid container 11*b* has a side wall 70*b* with an indentation 72*b*.

Still referring to FIGS. 2A and 2B, the cleaning system 8*b* includes a cleaning implement (similar to cleaning implement 40*a* of FIG. 1D) having an elongated cylindrical handle 42*b* and a mop head with a removable cleaning pad. A tubular first support 50*b* is attached to and surrounds the handle 42*b*. The support 50*b* has a circumferential section 52*b* that extends upward and away from the handle 42*b* thereby creating an annular space 53*b* between the section 52*b* and the handle 42*b*. The section 52*b* can also extend only part of the way around the top of the support 50*b* thereby creating an arcuate section that extends upward and away from the handle 42*b*.

The attachable dispenser 10*b* of the cleaning system 8*b* is attached to the handle 42*b* of the cleaning implement as follows. The indentation 72*b* is aligned with the handle 42*b*. The projection 36*b* of the body 12*b* of the attachable dispenser 10*b* is placed in the space 53*b* between the section 52*b* and the handle 42*b*. A user can then clean a floor 78*a* (as shown in FIG. 1D) with the attachable dispenser 10*b* securely attached to the handle 42*b* of the cleaning implement. The indentation 72*b* prevents side to side movement of the attachable dispenser 10*b* when cleaning a floor. When an occasion arises in which the user wishes to spray fluid from the fluid container 11*b* onto the floor, the user can pull the attachable dispenser 10*b* off of the support 50*a*. After spraying fluid on the floor, the attachable dispenser 10*b* can be reattached to the handle 42*b* as described above.

Figure 3A:
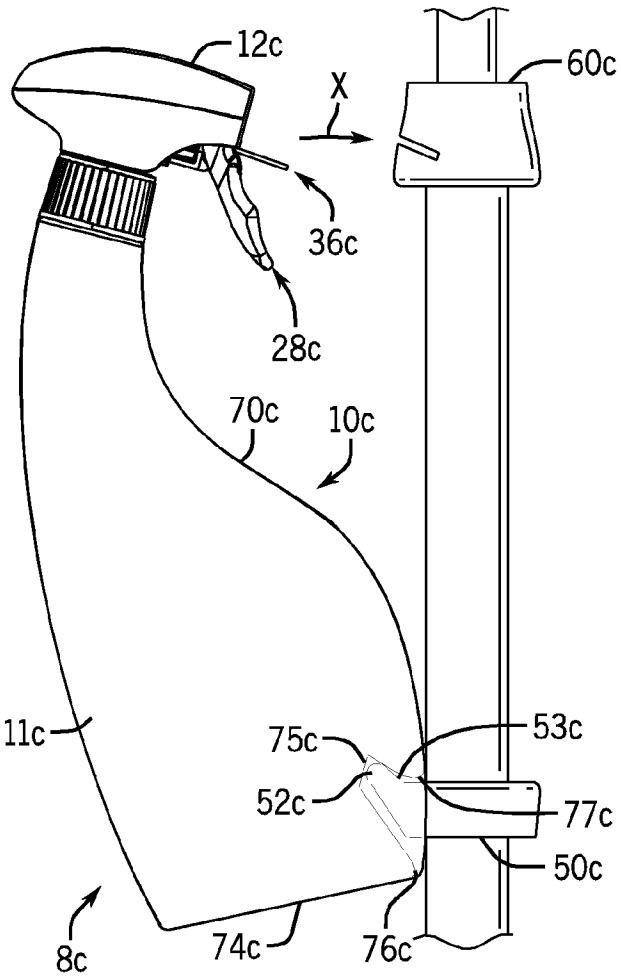
FIGS. 3A to 3C show a third embodiment of a cleaning system according to the invention with FIG. 3A being a partial side view of the dispenser being attached to the handle of the cleaning implement of this cleaning system, FIG. 3B being a front perspective view of the dispenser of this cleaning system, and FIG. 3C being a side view of the dispenser of this cleaning system.
Figure 3C:
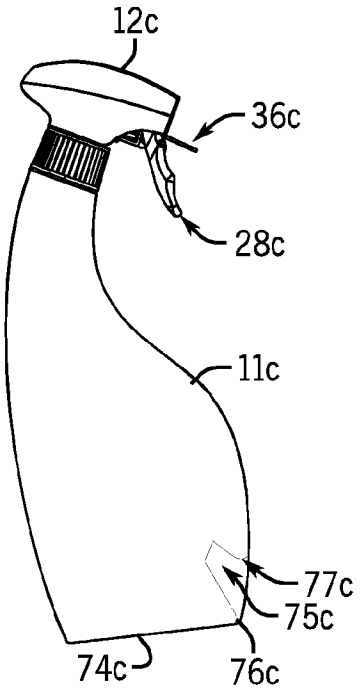
Figure 3B:
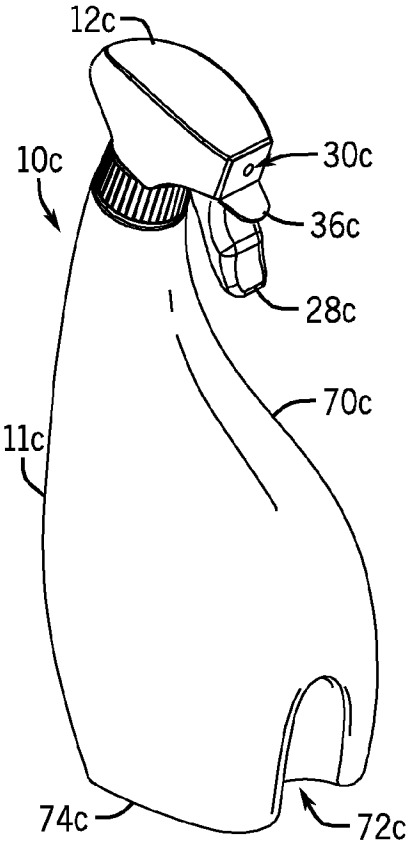

FIGS. 3A to 3C show a third example embodiment of a cleaning system 8*c* according to the invention. The cleaning system 8*c* includes an attachable dispenser 10*c* having a fluid container 11*c* and a body 12*c* that has connection means to connect the body 12*c* to the container 11*c*. The attachable dispenser 10*c* includes a sprayer mechanism formed within the body 12*c*. The dispenser 10*c* also includes a cylindrical dip tube for transferring fluid to the sprayer mechanism from the container 11*c* as in the dispenser 10 of FIG. 1. The dispenser 10*c* includes a finger operated trigger 28*c* to draw liquid into the sprayer mechanism and then expel liquid from a circular discharge orifice 30*c* as in the dispenser 10 of FIG. 1. A projection 36*c* extends outward from the body 12*c* adjacent the discharge orifice 30*c*. The fluid container 11*c* has a side wall 70*c* with an indentation 72*c*. The fluid container 11*c* has a bottom wall 74*c* having an inwardly directed arcuate recess 75*c* that terminates in an inner bottom edge 76*c* and an outer bottom edge 77*c*.

Still referring to FIGS. 3A to 3C, the cleaning system 8*c* includes a cleaning implement having an elongated cylindrical handle 42*c* and a mop head with a removable cleaning pad. A first support 50*c* is attached to and surrounds the handle 42*c*. The support 50*c* has a section 52*c* that extends upward and away from the handle 42*c* thereby creating an annular space 53*c* between the section 52*c* and the handle 42*c*. A second support 60*c* is also attached to and surrounds the handle 42*c*. The second support 60*c* is spaced above the first support 50*c*. The second support 60*c* has a slot 64*c*.

FIG. 3A shows how the attachable dispenser 10*c* of the cleaning system 8*c* is attached to the handle 42*c* of the cleaning implement. First, the outer bottom edge 77*c* of the recess 75*c* of the fluid container 11*c* is placed in the space 53*c* between the section 52*c* and the handle 42*c* such that the section 52*c* of the first support 50*c* is located in the recess 75*c* of the fluid container 11*c* and the inner bottom edge 76*c* of the recess 75*c* is outside the section 52*c* of the first support 50*c*. The indentation 72*c* is also aligned with the handle 42*c*. The attachable dispenser 10*c* is then moved in direction X in FIG. 3A until the projection 36*c* of the body 12*c* snaps into the slot 64*c* of the second support 60*c* as shown in FIG. 3A. A user can then clean a floor 78*a* as shown in FIG. 1D with the attachable dispenser 10*c* securely attached to the handle 42*c* of the cleaning implement. When an occasion arises in which the user wishes to spray fluid from the fluid container 11*c* onto the floor, the user can pull the attachable dispenser 10*c* in a direction opposite to direction X in FIG. 3A such that the projection 36*c* of the body 12*c* disengages from the slot 64*c* of the second support 60*c*. After spraying fluid on the floor, the attachable dispenser 10*c* can be reattached to the handle 42*c* as described above.

Figure 4C:
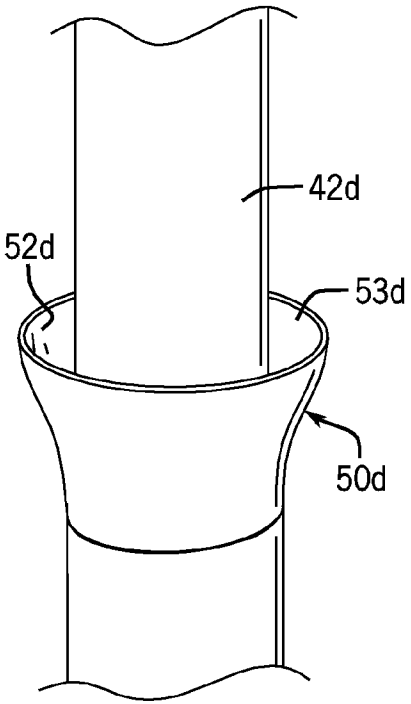
FIGS. 4A to 4C show a fourth embodiment of a cleaning system according to the invention with FIG. 4A being a partial side view of the dispenser attached to the handle of the cleaning implement of this cleaning system, FIG. 4B being a front perspective view of the dispenser of this cleaning system, and FIG. 4C being a front detailed perspective view of the handle of the cleaning implement of this cleaning system.
Figure 4A:
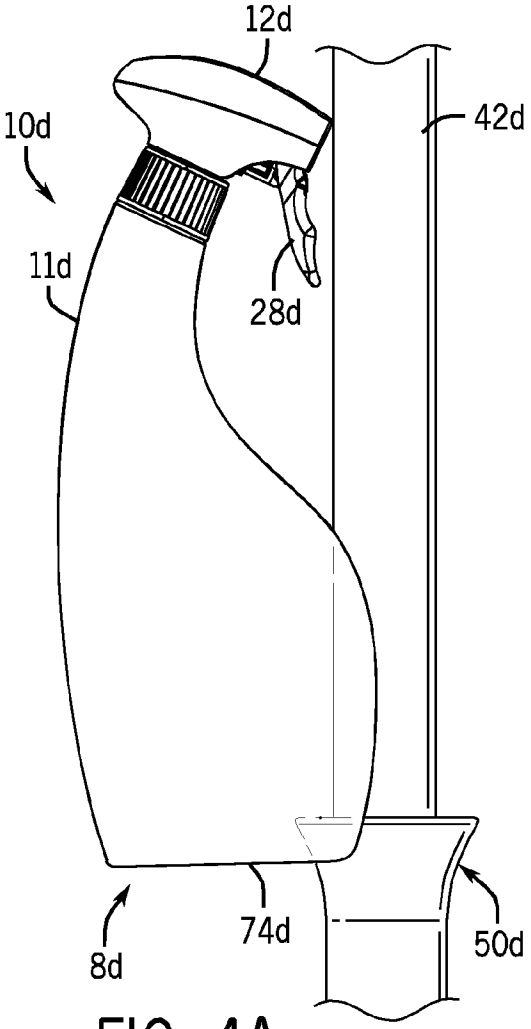
Figure 4B:
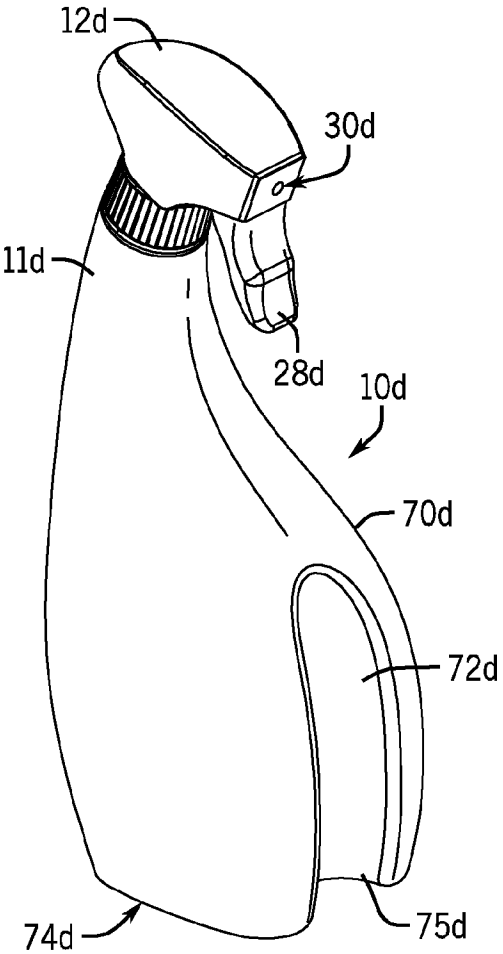

FIGS. 4A to 4C show a fourth example embodiment of a cleaning system 8*d* according to the invention. The cleaning system 8*d* includes an attachable dispenser 10*d* having a fluid container 11*d* and a body 12*d* that has connection means to connect the body 12*d* to the container 11*d*. The attachable dispenser 10*d* includes a sprayer mechanism formed within the body 12*d*. The dispenser 10*d* also includes a cylindrical dip tube for transferring fluid to the sprayer mechanism from the container 11*d* as in the dispenser 10 of FIG. 1. The dispenser 10*d* includes a finger operated trigger 28*d* to draw liquid into the sprayer mechanism and then expel liquid from a circular discharge orifice 30*d* as in the dispenser 10 of FIG. 1. The fluid container 11*d* has a side wall 70*d* with an indentation 72*d*. The fluid container 11*d* has a bottom wall 74*d* having an inwardly directed arcuate recess 75*d* that terminates in an inner bottom edge and an outer bottom edge as in attachable dispenser 10*a* of FIG. 1A.

Still referring to FIGS. 4A to 4C, the cleaning system 8*d* includes a cleaning implement having an elongated cylindrical handle 42*d* and a mop head with a removable cleaning pad. A support 50*d* is attached to and surrounds the handle 42*d*. The support 50*d* has a section 52*d* that extends upward and away from the handle 42*d* thereby creating an annular space 53*d* between the section 52*d* and the handle 42*d*.

FIG. 4A shows how the attachable dispenser 10*d* of the cleaning system 8*d* is attached to the handle 42*d* of the cleaning implement. First, the outer bottom edge of the recess 75*d* of the fluid container 11*d* is placed in the space 53*d* between the section 52*d* and the handle 42*d* such that the section 52*d* of the support 50*d* is located in the recess 75*d* of the fluid container 11*d* and the inner bottom edge of the recess 75*d* is outside the section 52*d* of the support 50*d*. The indentation 72*d* is also aligned with the handle 42*d*. A user can then clean a floor 78*a* as shown in FIG. 1D with the attachable dispenser 10*d* securely attached to the handle 42*d* of the cleaning implement. When an occasion arises in which the user wishes to spray fluid from the fluid container 11*d* onto the floor, the user can pull the attachable dispenser 10*d* off of the support 50*d*. After spraying fluid on the floor, the attachable dispenser 10*d* can be reattached to the handle 42*d* as described above.

Figure 5:
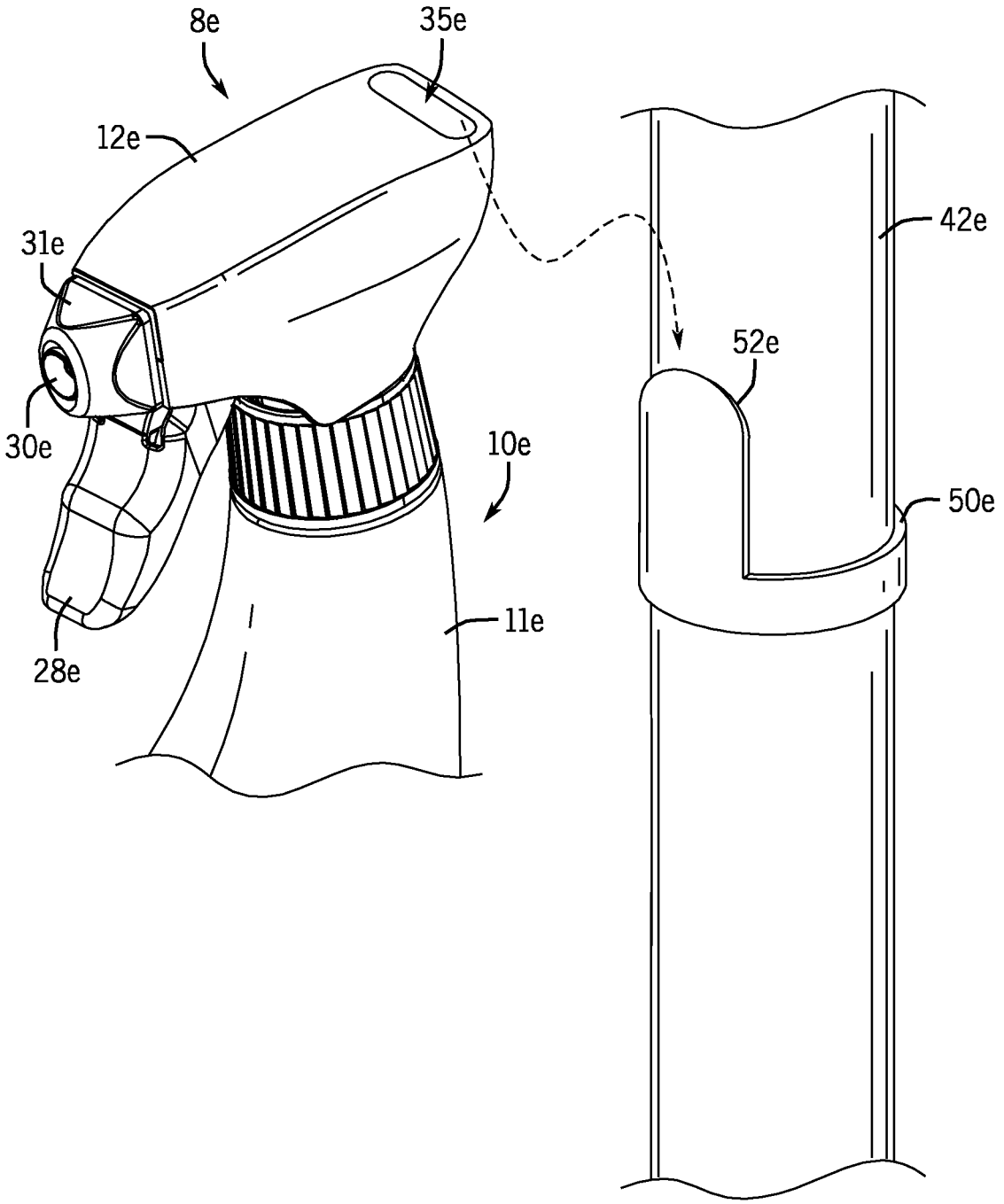
FIG. 5 shows a front detailed perspective view of the dispenser being attached to the handle of the cleaning implement of a fifth embodiment of a cleaning system according to the invention.

FIG. 5 shows a fifth example embodiment of a cleaning system 8*e* according to the invention. The cleaning system 8*e* includes an attachable dispenser 10*e* having a fluid container 11*e* and a body 12*e* that has connection means to connect the body 12*e* to the container 11*e*. The attachable dispenser 10*e* includes a sprayer mechanism formed within the body 12*e*. The dispenser 10*e* also includes a cylindrical dip tube for transferring fluid to the sprayer mechanism from the container 11*e* as in the dispenser 10 of FIG. 1. The dispenser 10*e* includes a finger operated trigger 28*e* to draw liquid into the sprayer mechanism and then expel liquid from a circular discharge orifice 30*e* in a nozzle cap 31*e* as in the dispenser 10 of FIG. 1. The body 12*e* has an opening 35*e* that extends through a rear end portion of the body 12*e*.

Still referring to FIG. 5, the cleaning system 8*e* includes a cleaning implement having an elongated cylindrical handle 42*e* and a mop head with a removable cleaning pad. A support 50*e* is attached to and surrounds the handle 42*e*. The support 50*e* has a section 52*e* that extends upward and away from the handle 42*e* thereby creating a space between the section 52*e* and the handle 42*e*.

FIG. 5 shows how the attachable dispenser 10*e* of the cleaning system 8*e* is attached to the handle 42*e* of the cleaning implement. The opening 35*e* of the body 12*e* is placed over the section 52*e* of the support 50*e*. A user can then clean a floor 78*a* as shown in FIG. 1D with the attachable dispenser 10*e* attached to the handle 42*e* of the cleaning implement. When an occasion arises in which the user wishes to spray fluid from the fluid container 11*e* onto the floor, the user can pull the attachable dispenser 10*e* off of the support 50*e*. After spraying fluid on the floor, the attachable dispenser 10*e* can be reattached to the handle 42*e* as described above.

FIGS. 6A to 6D show a sixth example embodiment of a cleaning system 8*f* according to the invention. The cleaning system 8*f* includes an attachable dispenser 10*f* having a fluid container 11*f* and a body 12*f* that has connection means to connect the body 12*f* to the container 11*f*. The attachable dispenser 10*f* includes a sprayer mechanism formed within the body 12*f*. The dispenser 10*f* also includes a cylindrical dip tube for transferring fluid to the sprayer mechanism from the container 11*f* as in the dispenser 10 of FIG. 1. The dispenser 10*f* includes a finger operated trigger 28*f* to draw liquid into the sprayer mechanism and then expel liquid from a circular discharge orifice as in the dispenser 10 of FIG. 1. The fluid container 11*f* has a bottom wall 74*f* and a side wall 70*f* with an indentation 72*f* and an inwardly directed recess 75*f* that terminates in an inner edge 76*f* and an outer edge 77*f*.

Figure 6D:
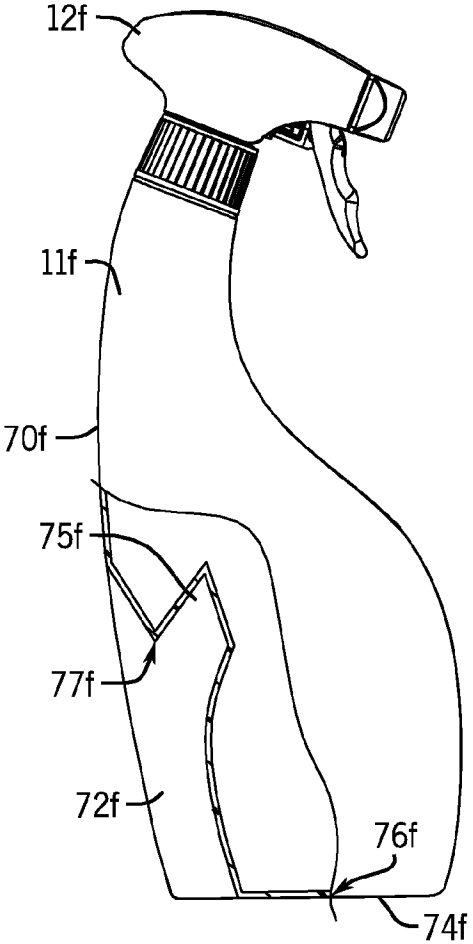
FIGS. 6A to 6D show a sixth embodiment of a cleaning system according to the invention with FIG. 6A being a front detailed perspective view of the handle of the cleaning implement of this cleaning system, FIG. 6B being a side detailed view of the handle of the cleaning implement of this cleaning system, FIG. 6C being a rear perspective view of the dispenser of this cleaning system, and FIG. 6D being a partially cross-sectional view of the dispenser of this cleaning system taken along line 6D-6D of FIG. 6C.
Figure 6C:
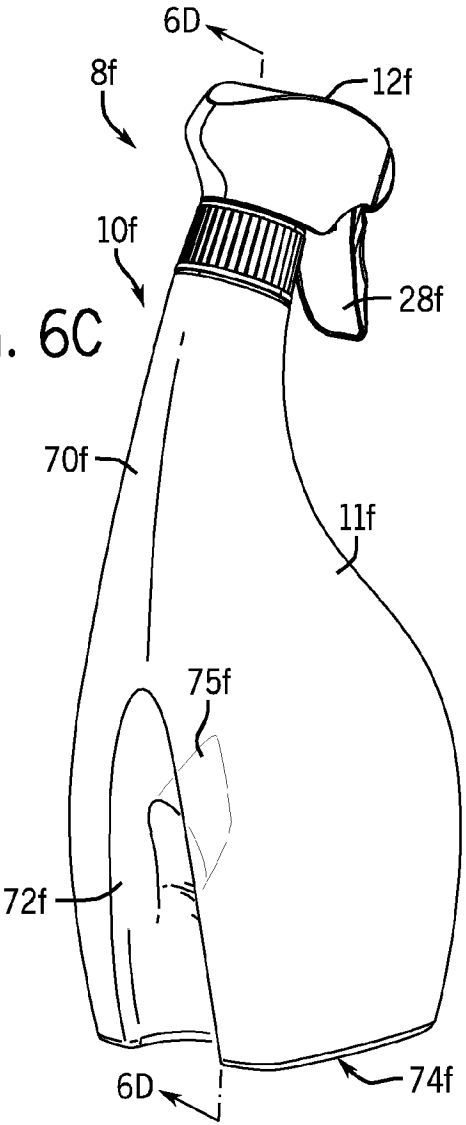
Figure 6B:
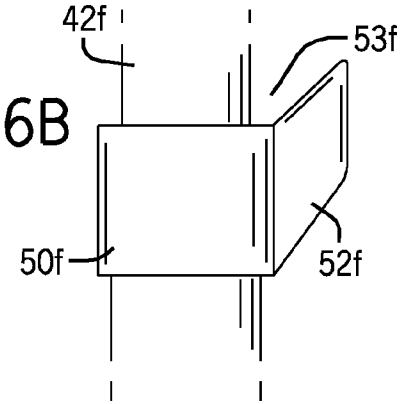
Figure 6A:
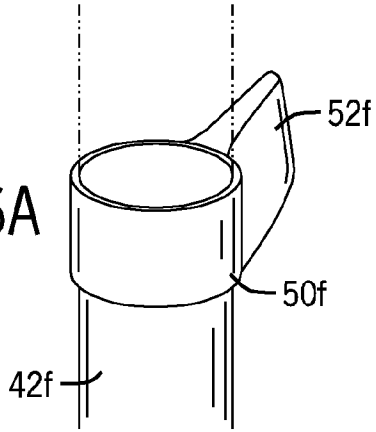

Still referring to FIGS. 6A and 6B, the cleaning system 8*f* includes a cleaning implement having an elongated cylindrical handle 42*f* and a mop head with a removable cleaning pad. A support 50*f* is attached to and surrounds the handle 42*f*. The support 50*f* has a section 52*f* that extends upward and away from the handle 42*f* thereby creating a space 53*f* between the section 52*f* and the handle 42*f*.

The attachable dispenser 10*f* of the cleaning system 8*f* is attached to the handle 42*f* of the cleaning implement. First, the outer bottom edge 77*f* of the recess 75*f* of the fluid container 11*f* is placed in the space 53*f* between the section 52*f* and the handle 42*f* such that the section 52*f* of the support 50*f* is located in the recess 75*f* of the fluid container 11*f* and the inner bottom edge 76*f* of the recess 75*f* is outside the section 52*f* of the support 50*f*. The indentation 72*f* is also aligned with the handle 42*f*. A user can then clean a floor 78*a* as shown in FIG. 1D with the attachable dispenser 10*f* securely attached to the handle 42*f* of the cleaning implement. When an occasion arises in which the user wishes to spray fluid from the fluid container 11*f* onto the floor, the user can pull the attachable dispenser 10*f* off of the support 50*f*. After spraying fluid on the floor, the attachable dispenser 10*f* can be reattached to the handle 42*f* as described above.

Figure 7B:
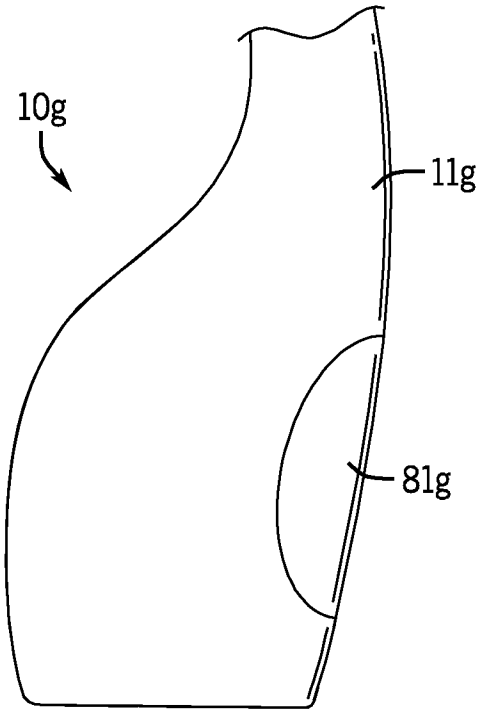
FIGS. 7A and 7B show a seventh embodiment of a cleaning system according to the invention with FIG. 7A being a front perspective view of the dispenser of this cleaning system and FIG. 7B being a partial side view of the dispenser of this cleaning system.
Figure 7A:
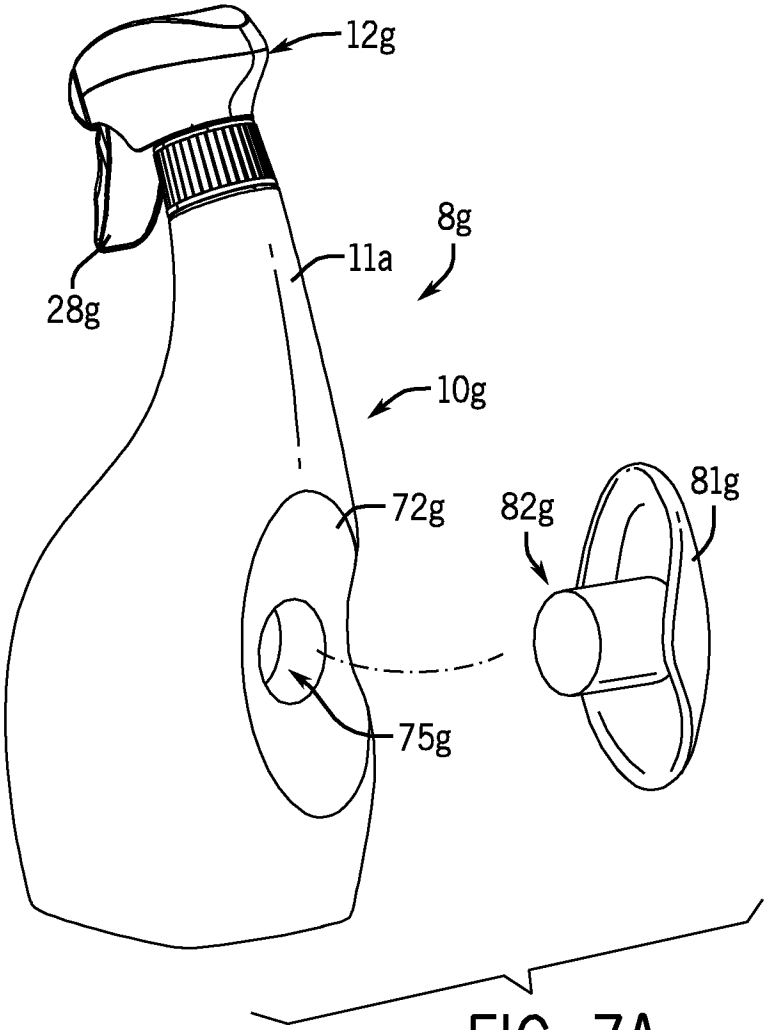

FIGS. 7A and 7B show a seventh example embodiment of a cleaning system 8*g* according to the invention. The cleaning system 8*g* includes an attachable dispenser 10*g* having a fluid container 11*g* and a body 12*g* that has connection means to connect the body 12*g* to the container 11*g*. The attachable dispenser 10*g* includes a sprayer mechanism formed within the body 12*g*. The dispenser 10*g* also includes a cylindrical dip tube for transferring fluid to the sprayer mechanism from the container 11*g* as in the dispenser 10 of FIG. 1. The dispenser 10*g* includes a finger operated trigger 28*g* to draw liquid into the sprayer mechanism and then expel liquid from a circular discharge orifice as in the dispenser 10 of FIG. 1. The fluid container 11*g* has a side wall 70*g* with an indentation 72*g* and an inwardly directed recess 75*g*. The fluid container 11*g* can be formed by injection molding the fluid container 11*g* around a molding insert 81*g* having a protrusion 82*g*.

The attachable dispenser 10*g* of the cleaning system 8*g* is attached to a handle of a cleaning implement. A protrusion of the handle is placed in the recess 75*g* of the fluid container 11*g*. A user can then clean a floor 78*a* as shown in FIG. 1D with the attachable dispenser 10*g* securely attached to the handle of the cleaning implement. When an occasion arises in which the user wishes to spray fluid from the fluid container 11*g* onto the floor, the user can pull the attachable dispenser 10*g* off of the handle. After spraying fluid on the floor, the attachable dispenser 10*g* can be reattached to the handle.

Figure 8A:
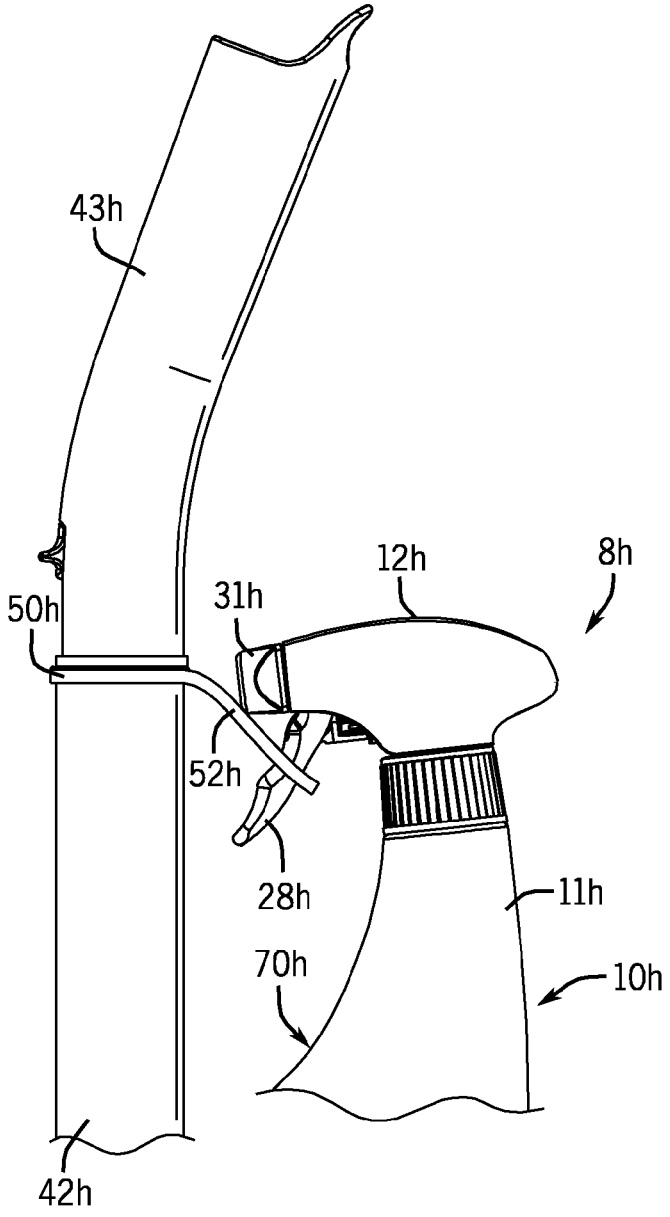
FIGS. 8A and 8B show an eighth embodiment of a cleaning system according to the invention with FIG. 8A being a partial side view of the dispenser attached to the handle of the cleaning implement of this cleaning system, and FIG. 8B being a rear partial perspective view of the handle of this cleaning system.
Figure 8B:
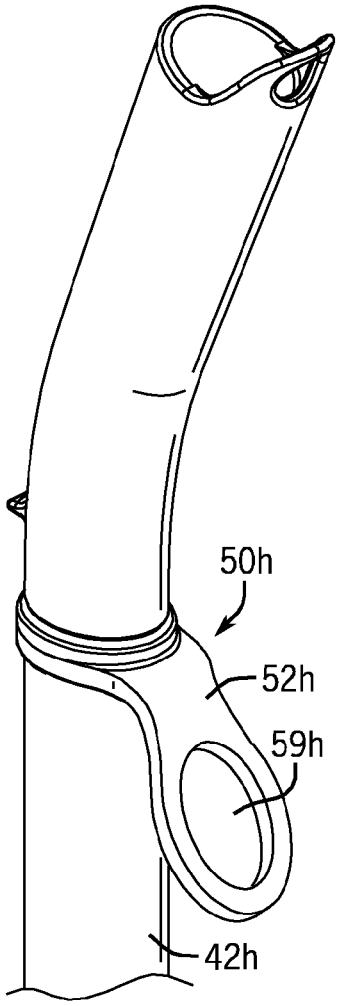

FIGS. 8A and 8B show an eighth example embodiment of a cleaning system 8*h* according to the invention. The cleaning system 8*h* includes an attachable dispenser 10*h* having a fluid container 11*h* and a body 12*h* that has connection means to connect the body 12*h* to the container 11*h*. The attachable dispenser 10*h* includes a sprayer mechanism formed within the body 12*h*. The dispenser 10*h* also includes a cylindrical dip tube for transferring fluid to the sprayer mechanism from the container 11*h* as in the dispenser 10 of FIG. 1. The dispenser 10*h* includes a finger operated trigger 28*h* to draw liquid into the sprayer mechanism and then expel liquid from a circular discharge orifice in a nozzle cap 31*h* as in the dispenser 10 of FIG. 1. The fluid container 11*h* has a side wall 70*h* with an indentation similar to indentation 72*a* of the embodiment of FIG. 1A.

Still referring to FIGS. 8A and 8B, the cleaning system 8*h* includes a cleaning implement (similar to cleaning implement 40*a* of FIG. 1D) having an elongated cylindrical handle 42*h* and a grip section 43*h* and a mop head with a removable cleaning pad. A support 50*h* is attached to and surrounds the handle 42*h*. The support 50*h* has a section 52*h* that extends away from the handle 42*h*. The section 52*h* includes an opening 59*h*.

The attachable dispenser 10*h* of the cleaning system 8*h* is attached to the handle 42*h* of the cleaning implement as follows. The indentation is aligned with the handle 42*h* (as in FIG. 1E). The trigger 28*h* of the body 12*h* of the attachable dispenser 10*h* is placed in the opening 59*h* of the support 50*h*. A user can then clean a floor 78*a* (as shown in FIG. 1D) with the attachable dispenser 10*h* securely attached to the handle 42*h* of the cleaning implement. The indentation prevents side to side movement of the attachable dispenser 10*h* when cleaning a floor. When an occasion arises in which the user wishes to spray fluid from the fluid container 11*h* onto the floor, the user can pull the attachable dispenser 10*h* off of the support 50*h*. After spraying fluid on the floor, the attachable dispenser 10*h* can be reattached to the handle 42*h* as described above.

Figure 9B:
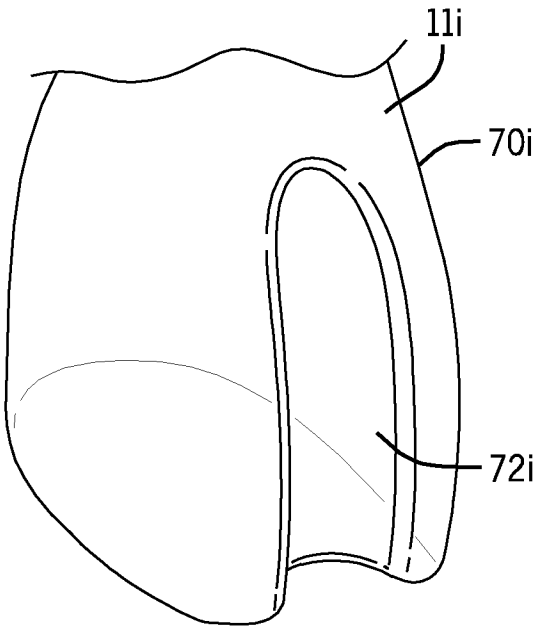
FIGS. 9A and 9B show a ninth embodiment of a cleaning system according to the invention with FIG. 9A being a rear partial perspective view of the dispenser of this cleaning system, and FIG. 9B being a rear partial perspective view of the container of this cleaning system.
Figure 9A:
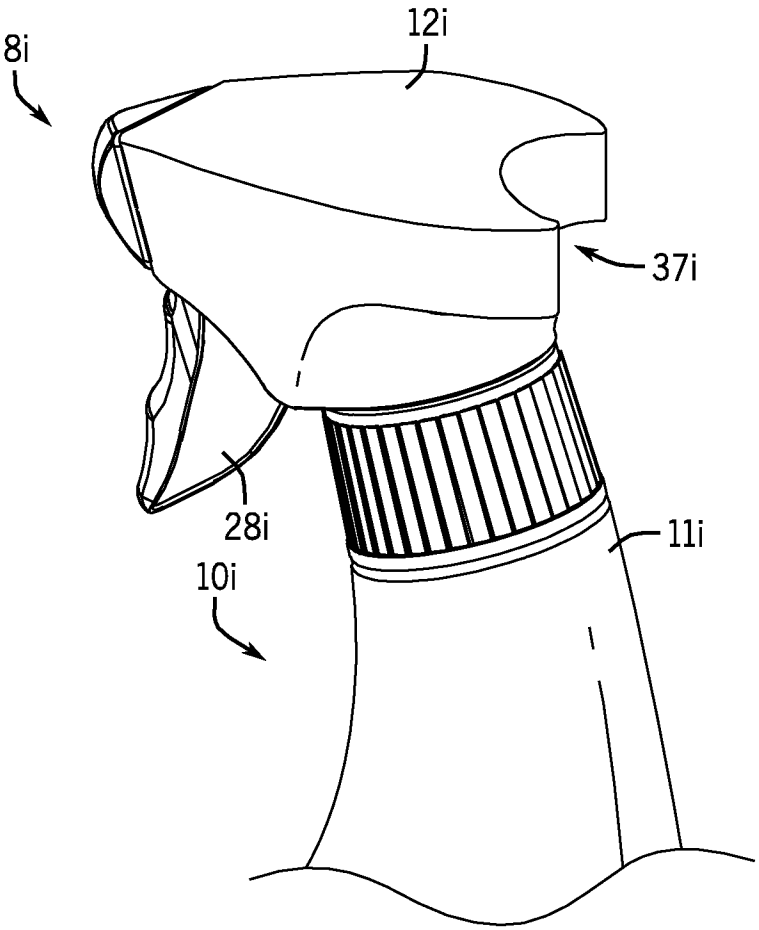

FIGS. 9A and 9B show a ninth example embodiment of a cleaning system 8*i* according to the invention. The cleaning system 8*i* includes an attachable dispenser 10*i* having a fluid container 11*i* and a body 12*i* that has connection means to connect the body 12*i* to the container 11*i*. The attachable dispenser 10*i* includes a sprayer mechanism formed within the body 12*i*. The dispenser 10*i* also includes a cylindrical dip tube for transferring fluid to the sprayer mechanism from the container 11*i* as in the dispenser 10 of FIG. 1. The dispenser 10*i* includes a finger operated trigger 28*i* to draw liquid into the sprayer mechanism and then expel liquid from a circular discharge orifice as in the dispenser 10 of FIG. 1. The body 12*i* has an inwardly directed recess 37*i* in the rear end portion. The fluid container 11*i* has a side wall 70*i* with an indentation 72*i*.

The attachable dispenser 10*i* of the cleaning system 8*i* is attached to the handle of a cleaning implement as follows. The indentation 72*i* is aligned with the handle (as in FIG. 1E). The recess 37*i* of the body 12*i* of the attachable dispenser 10*i* is snapped over the handle to create a friction fit between the body 12*i* and the handle. A user can then clean a floor 78*a* (as shown in FIG. 1D) with the attachable dispenser 10*i* securely attached to the handle of the cleaning implement. The indentation 72*i* prevents side to side movement of the attachable dispenser 10*i* when cleaning a floor. When an occasion arises in which the user wishes to spray fluid from the fluid container 11*i* onto the floor, the user can pull the attachable dispenser 10*i* off of the handle. After spraying fluid on the floor, the attachable dispenser 10*i* can be reattached to the handle as described above.

Figure 10A:
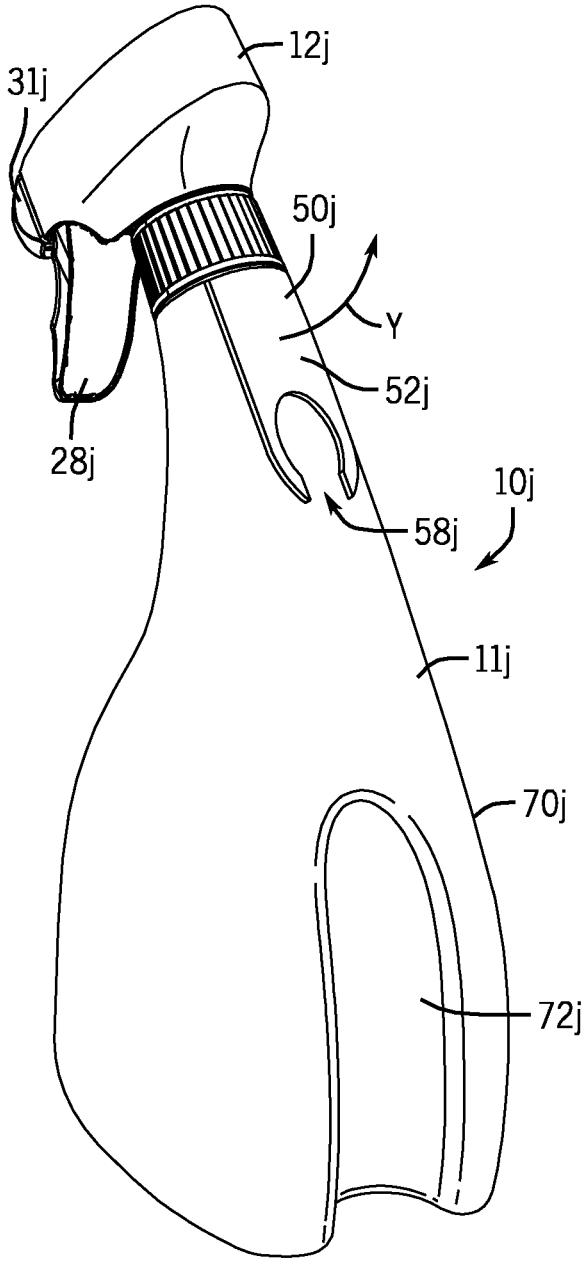
FIGS. 10A and 10B show a tenth embodiment of a cleaning system according to the invention with FIG. 10A being a rear partial perspective view of the dispenser of this cleaning system, and FIG. 10B being a partial side view of the dispenser attached to the handle of the cleaning implement of this cleaning system.
Figure 10B:
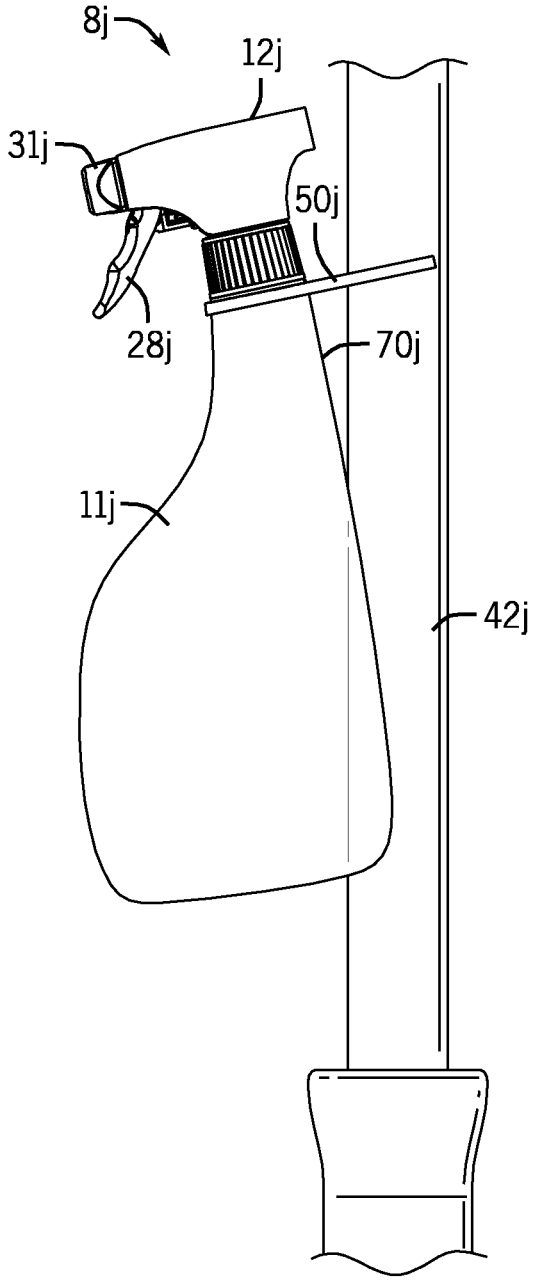

FIGS. 10A and 10B show a tenth example embodiment of a cleaning system 8*j* according to the invention. The cleaning system 8*j* includes an attachable dispenser 10*j* having a fluid container 11*j* and a body 12*j* that has connection means to connect the body 12*j* to the container 11*j*. The attachable dispenser 10*j* includes a sprayer mechanism formed within the body 12*j*. The dispenser 10*j* also includes a cylindrical dip tube for transferring fluid to the sprayer mechanism from the container 11*j* as in the dispenser 10 of FIG. 1. The dispenser 10*j* includes a finger operated trigger 28*j* to draw liquid into the sprayer mechanism and then expel liquid from a circular discharge orifice in a nozzle cap 31*j* as in the dispenser 10 of FIG. 1. The attachable dispenser 10*j* includes a support 50*j* hinged to the attachable dispenser 10*j*. The support 50*j* has a section 52*j* that extends away from the attachable dispenser 10*j* when the support 50*j* is moved from the first storage position shown in FIG. 10A to the second position shown in FIG. 10B by movement in direction Y shown in FIG. 10A. The section 52*j* of the support 50*j* includes a recess 58*j* at its outer end.

The attachable dispenser 10*j* of the cleaning system 8*j* is attached to the handle 42*j* of a cleaning implement as follows. The indentation 72*j* is aligned with the handle 42*j* (as in FIG. 1E). The recess 58*j* of the support 50*j* is snapped over the handle 42*j* to create a friction fit between the support 50*j* and the handle 42*j*. A user can then clean a floor 78*a* (as shown in FIG. 1D) with the attachable dispenser 10*j* securely attached to the handle 42*j* of the cleaning implement. The indentation 72*j* prevents side to side movement of the attachable dispenser 10*j* when cleaning a floor. When an occasion arises in which the user wishes to spray fluid from the fluid container 11*j* onto the floor, the user can pull the attachable dispenser 10*j* off of the handle 42*j*. After spraying fluid on the floor, the attachable dispenser 10*j* can be reattached to the handle as described above.

Figure 11B:
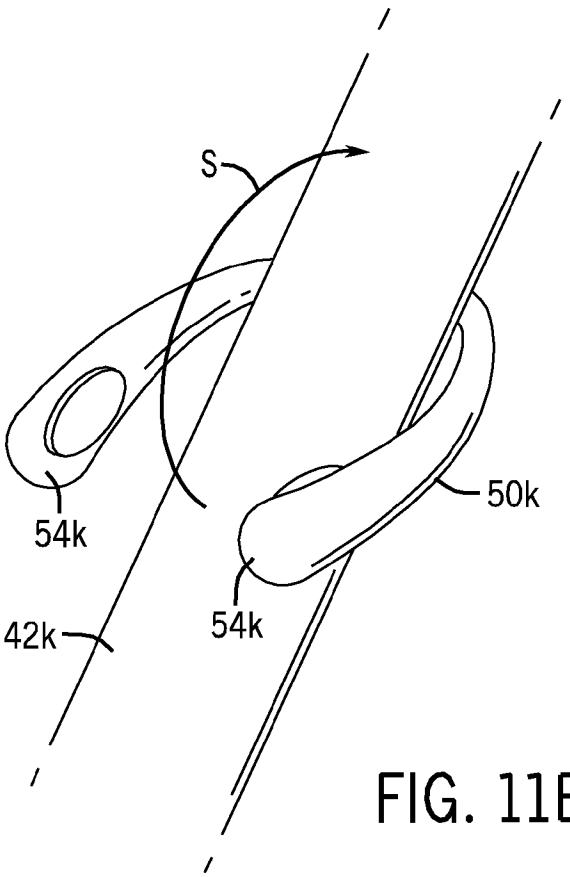
FIGS. 11A and 11B show an eleventh embodiment of a cleaning system according to the invention with FIG. 11A being a partial side view of the dispenser attached to the handle of the cleaning implement of this cleaning system, and FIG. 11B being a partial perspective view of the handle of this cleaning system.
Figure 11A:
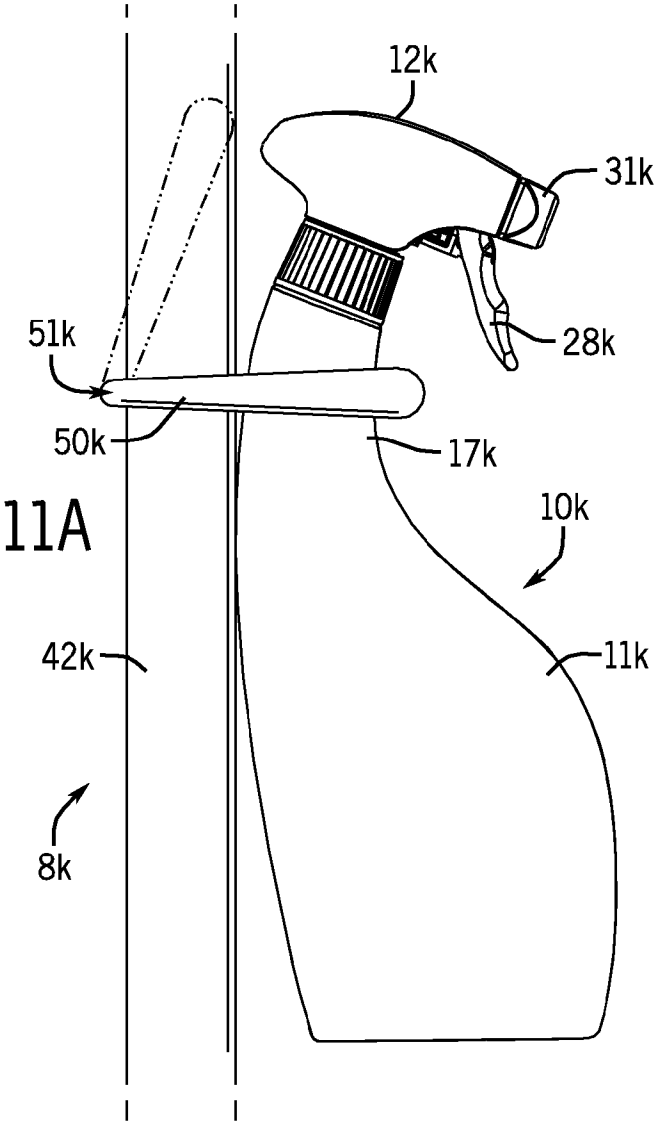

FIGS. 11A and 11B show an eleventh example embodiment of a cleaning system 8*k* according to the invention. The cleaning system 8*k* includes an attachable dispenser 10*k* having a fluid container 11*k* and a body 12*k* that has connection means to connect the body 12*k* to the container 11*k* which has neck 17*k*. The attachable dispenser 10*k* includes a sprayer mechanism formed within the body 12*k*. The dispenser 10*k* also includes a cylindrical dip tube for transferring fluid to the sprayer mechanism from the container 11*k* as in the dispenser 10 of FIG. 1. The dispenser 10*k* includes a finger operated trigger 28*k* to draw liquid into the sprayer mechanism and then expel liquid from a circular discharge orifice in a nozzle cap 31*k* as in the dispenser 10 of FIG. 1.

The cleaning system 8*k* includes a cleaning implement with a handle 42*k*. The handle 42*k* includes a support 50*k* hinged to the handle 42*k* at pivot point 51*k*. The support 50*k* has spaced apart arms 54*k* that extend away from the handle 42*k* when the support 50*k* is moved from the first storage position shown in FIG. 11A to the second position shown in FIG. 11B by movement opposite to direction S shown in FIG. 11B.

The attachable dispenser 10*k* of the cleaning system 8*k* is attached to the handle 42*k* of a cleaning implement as follows. The spaced apart arms 54*k* of the support 50*k* are snapped over the neck 17*k* of the container 11*k* to create a friction fit between the spaced apart arms 54*k* of the support 50*k* and the neck 17*k* of the container 11*k*. A user can then clean a floor 78*a* (as shown in FIG. 1D) with the attachable dispenser 10*k* securely attached to the handle 42*k* of the cleaning implement. When an occasion arises in which the user wishes to spray fluid from the fluid container 11*k* onto the floor, the user can pull the attachable dispenser 10*k* off of the handle 42*k*. After spraying fluid on the floor, the attachable dispenser 10*k* can be reattached to the handle as described above.

Figure 12A:
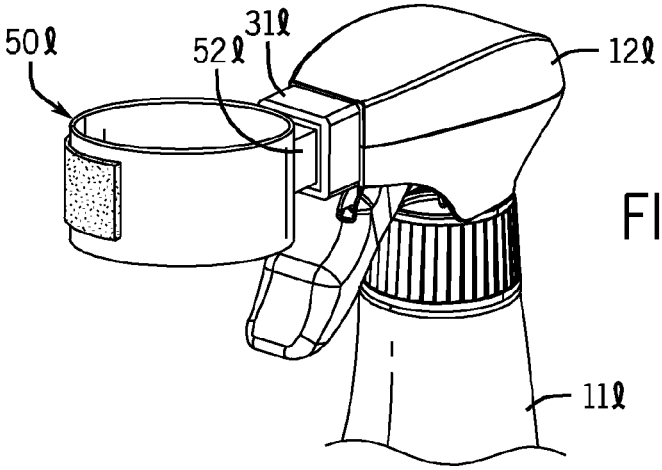
FIGS. 12A to 12C show a twelfth embodiment of a cleaning system according to the invention with FIG. 12A being a right partial perspective view of the dispenser attached to the handle support of the cleaning implement of this cleaning system, FIG. 12B being a left partial perspective view of the dispenser of this cleaning system, and FIG. 12C being a partial perspective view of the handle of this cleaning system.
Figure 12B:
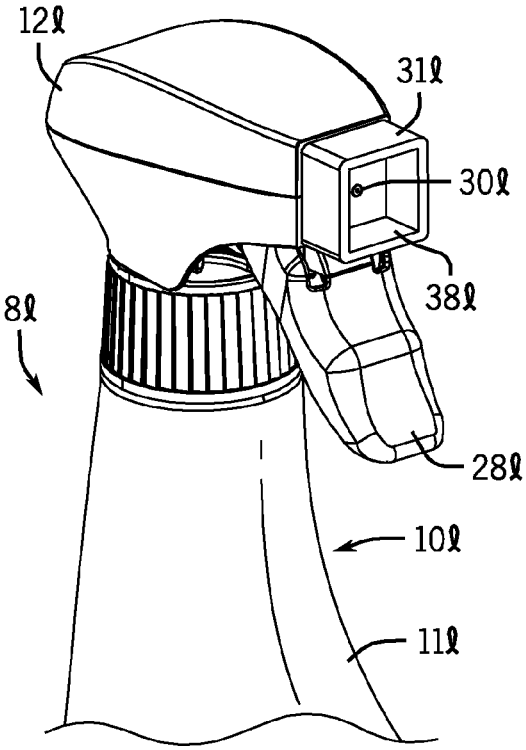
Figure 12C:
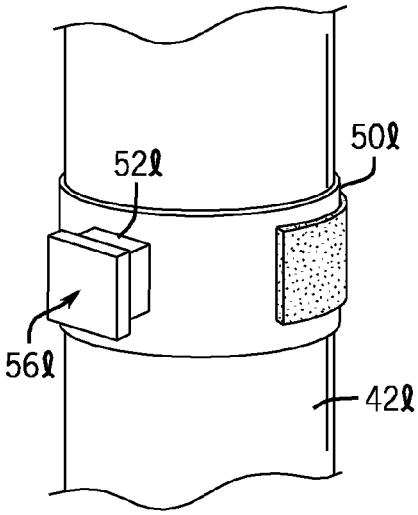

FIGS. 12A to 12C show a twelfth example embodiment of a cleaning system 8*l* according to the invention. The cleaning system 8*l* includes an attachable dispenser 10*l* having a fluid container 11*l* and a body 12*l* that has connection means to connect the body 12*l* to the container 11*l*. The attachable dispenser 10*l* includes a sprayer mechanism formed within the body 12*l*. The dispenser 10*l* also includes a cylindrical dip tube for transferring fluid to the sprayer mechanism from the container 11*l* as in the dispenser 10 of FIG. 1. The dispenser 10*l* includes a finger operated trigger 28*l* to draw liquid into the sprayer mechanism and then expel liquid from a circular discharge orifice 30*l* in a nozzle cap 31*l* as in the dispenser 10 of FIG. 1. The nozzle cap 31*l* has a generally square inwardly directed depression 38*l* around the discharge orifice 30*l*.

Still referring to FIGS. 12A and 12B, the cleaning system 8*l* includes a cleaning implement having an elongated cylindrical handle 42*l* and a mop head with a removable cleaning pad. A support 50*l* is attached by a hook and loop fastener system to the handle 42*l*. The support 50*l* surrounds the handle and has a projection 52*l* that extends away from the handle 42*l*. The projection 52*l* terminates in a square head 56*l*.

The attachable dispenser 10*l* of the cleaning system 8*l* is attached to the handle 42*l* of the cleaning implement as follows. The depression 38*l* of the nozzle cap 31*l* is placed over the head 56*l* of the projection 52*l* of the support 50*l* such that the nozzle cap 31*l* and the head 56*l* of the projection 52*l* of the support 50*l* are engaged in a friction fit. A user can then clean a floor 78*a* as shown in FIG. 1D with the attachable dispenser 10*l* attached to the handle 42*l* of the cleaning implement. When an occasion arises in which the user wishes to spray fluid from the fluid container 11*l* onto the floor, the user can pull the attachable dispenser 10*l* off of the support 50*l*. After spraying fluid on the floor, the attachable dispenser 10*l* can be reattached to the handle 42*l* as described above.

Figure 13:
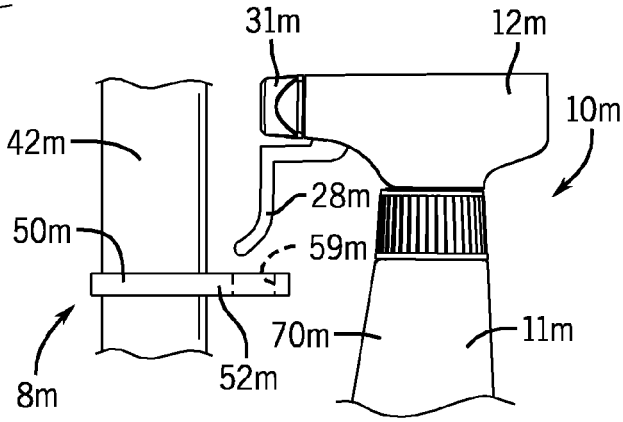
FIG. 13 shows a partial side view of the dispenser being attached to the handle of the cleaning implement of a thirteenth embodiment of a cleaning system according to the invention.

FIG. 13 shows a thirteenth example embodiment of a cleaning system 8*m* according to the invention. The cleaning system 8*m* includes an attachable dispenser 10*m* having a fluid container 11*m* and a body 12*m* that has connection means to connect the body 12*m* to the container 11*m*. The attachable dispenser 10*m* includes a sprayer mechanism formed within the body 12*m*. The dispenser 10*m* also includes a cylindrical dip tube for transferring fluid to the sprayer mechanism from the container 11*m* as in the dispenser 10 of FIG. 1. The dispenser 10*m* includes a finger operated trigger 28*m* to draw liquid into the sprayer mechanism and then expel liquid from a circular discharge orifice in a nozzle cap 31*m* as in the dispenser 10 of FIG. 1. The fluid container 11*m* has a side wall 70*m* with an indentation similar to indentation 72*a* of the embodiment of FIG. 1A.

Still referring to FIGS. 13A and 13B, the cleaning system 8*m* includes a cleaning implement (similar to cleaning implement 40*a* of FIG. 1D) having an elongated cylindrical handle 42*m* and a mop head with a removable cleaning pad. A support 50*m* is attached to and surrounds the handle 42*m*. The support 50*m* has a section 52*m* that extends away from the handle 42*m*. The section 52*m* includes an opening 59*m*.

The attachable dispenser 10*m* of the cleaning system 8*m* is attached to the handle 42*m* of the cleaning implement as follows. The indentation is aligned with the handle 42*m* (as in FIG. 1E). The trigger 28*m* of the body 12*m* of the attachable dispenser 10*m* is placed in the opening 59*m* of the support 50*m*. A user can then clean a floor 78*a* (as shown in FIG. 1D) with the attachable dispenser 10*m* securely attached to the handle 42*m* of the cleaning implement. The indentation prevents side to side movement of the attachable dispenser 10*m* when cleaning a floor. When an occasion arises in which the user wishes to spray fluid from the fluid container 11*m* onto the floor, the user can pull the attachable dispenser 10*m* off of the support 50*m*. After spraying fluid on the floor, the attachable dispenser 10*m* can be reattached to the handle 42*m* as described above.

Figure 14:
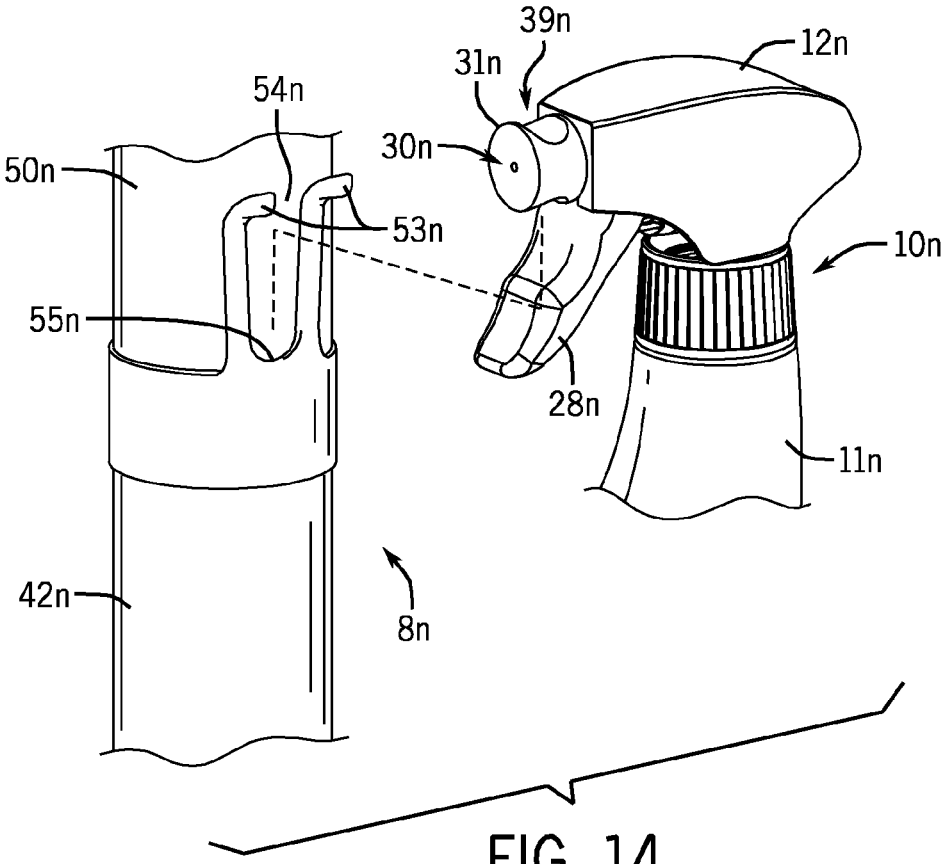
FIG. 14 shows a partial perspective view of the dispenser being attached to the handle of the cleaning implement of a fourteenth embodiment of a cleaning system according to the invention.

FIG. 14 shows a fourteenth example embodiment of a cleaning system 8*n* according to the invention. The cleaning system 8*n* includes an attachable dispenser 10*n* having a fluid container 11*n* and a body 12*n* that has connection means to connect the body 12*n* to the container 11*n*. The attachable dispenser 10*n* includes a sprayer mechanism formed within the body 12*n*. The dispenser 10*n* also includes a cylindrical dip tube for transferring fluid to the sprayer mechanism from the container 11*n* as in the dispenser 10 of FIG. 1. The dispenser 10*n* includes a finger operated trigger 28*n* to draw liquid into the sprayer mechanism and then expel liquid from a circular discharge orifice 30*n* in a nozzle cap 31*n* as in the dispenser 10 of FIG. 1. The nozzle cap 31*n* has an annular recess 39*n* around its circumference.

Still referring to FIG. 14, the cleaning system 8*n* includes a cleaning implement having an elongated cylindrical handle 42*n* and a mop head with a removable cleaning pad. A support 50*n* is attached to the handle 42*n*. The support 50*n* includes spaced apart upwardly directed arms 53*n* that form an upwardly opening slot 54*n* in the support 50*n*.

The attachable dispenser 10*n* of the cleaning system 8*n* is attached to the handle 42*n* of the cleaning implement as follows. The annular recess 39*n* of the nozzle cap 31*n* is placed between the arms 53*n* of the support 50*n* such that the nozzle cap 31*n* rests on the lower edge 55*n* of the slot 54*n*. A user can then clean a floor 78*a* as shown in FIG. 1D with the attachable dispenser 10*n* attached to the handle 42*n* of the cleaning implement. When an occasion arises in which the user wishes to spray fluid from the fluid container 11*n* onto the floor, the user can pull the attachable dispenser 10*n* off of the support 50*n*. After spraying fluid on the floor, the attachable dispenser 10*n* can be reattached to the handle 42*n* as described above.

Figure 15:
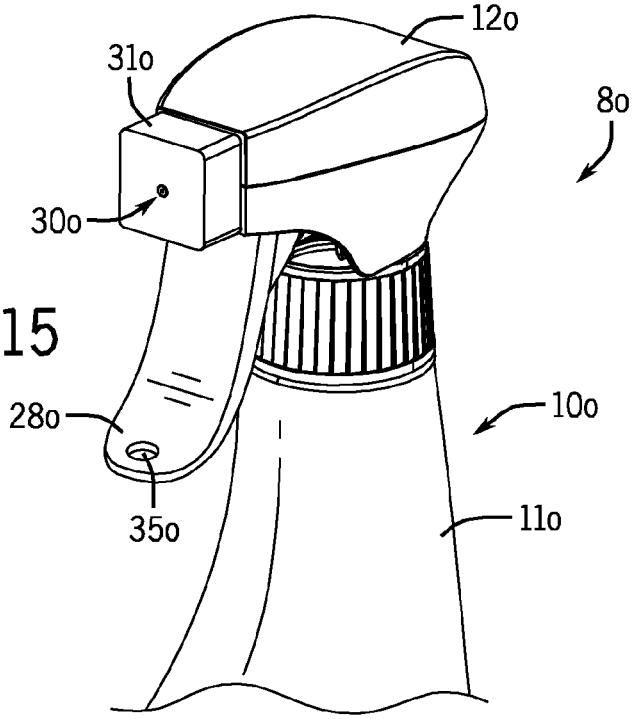
FIG. 15 shows partial perspective view of the dispenser of a fifteenth embodiment of a cleaning system according to the invention.

FIG. 15 shows a fifteenth example embodiment of a cleaning system 8*o* according to the invention. The cleaning system 8*o* includes an attachable dispenser 10*o* having a fluid container 11*o* and a body 12*o* that has connection means to connect the body 12*o* to the container 11*o*. The attachable dispenser 10*o* includes a sprayer mechanism formed within the body 12*o*. The dispenser 10*o* also includes a cylindrical dip tube for transferring fluid to the sprayer mechanism from the container 11*o* as in the dispenser 10 of FIG. 1. The dispenser 10*o* includes a finger operated trigger 28*o* to draw liquid into the sprayer mechanism and then expel liquid from a circular discharge orifice 30*o* in a nozzle cap 31*o* as in the dispenser 10 of FIG. 1. The trigger 28*o* has an opening 35*o* that extends through a bottom end portion of the trigger 28*o*.

The cleaning system 8*o* includes a cleaning implement having an elongated cylindrical handle. A support (similar to 50*e* in FIG. 5) is attached to and surrounds the handle. The support has a section that extends upward and away from the handle thereby creating a space between the section and the handle as in FIG. 5.

The attachable dispenser 10*o* of the cleaning system 8*o* is attached to the handle of the cleaning implement as follows. The opening 35*o* of the trigger 28*o* is placed over the section of the support. A user can then clean a floor 78*a* as shown in FIG. 1D with the attachable dispenser 10*o* attached to the handle of the cleaning implement. When an occasion arises in which the user wishes to spray fluid from the fluid container 11*o* onto the floor, the user can pull the attachable dispenser 10*o* off of the support. After spraying fluid on the floor, the attachable dispenser 10*o* can be reattached to the handle as described above.

Figure 16:
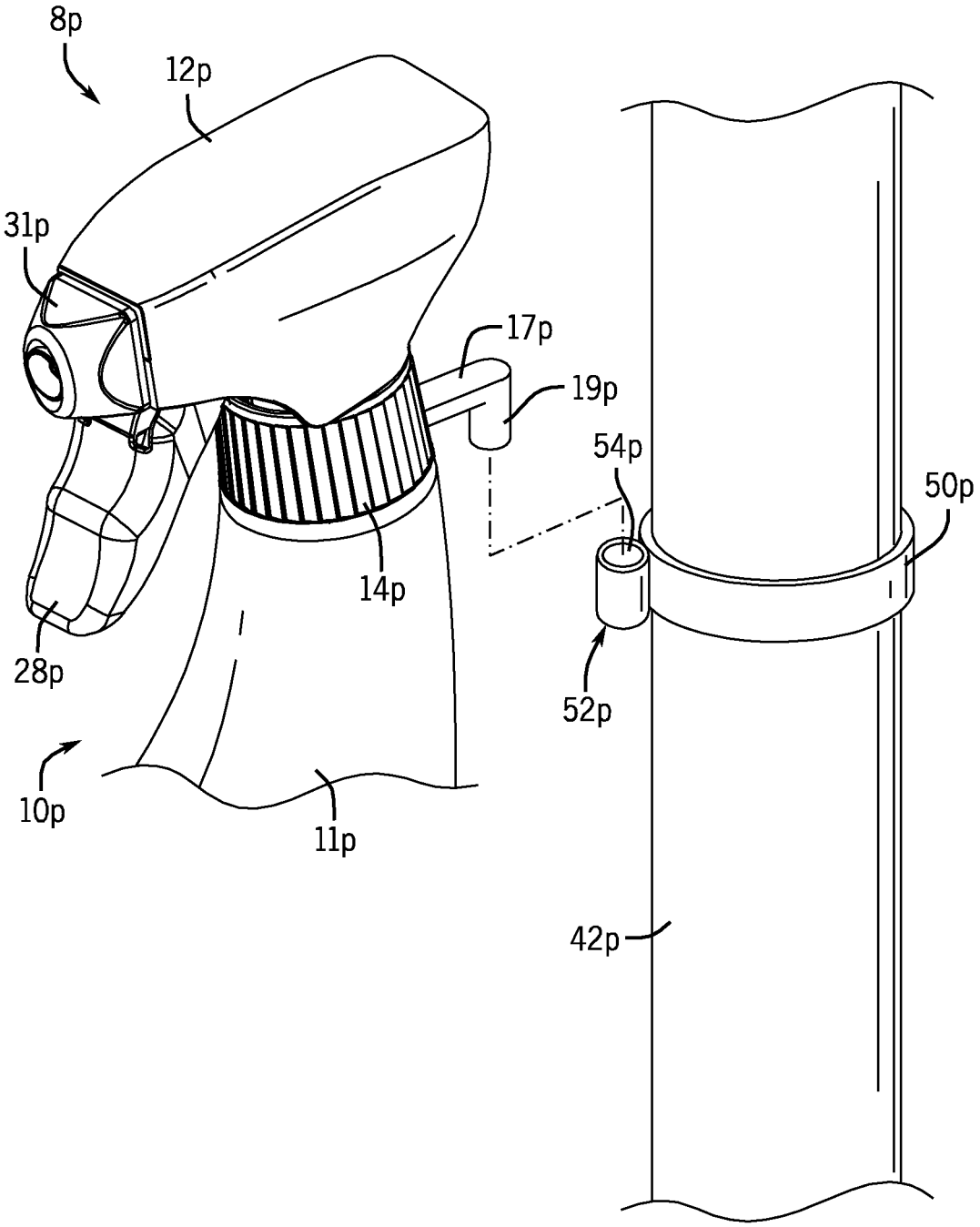
FIG. 16 shows a partial side view of the dispenser and the handle of the cleaning implement of a sixteenth embodiment of a cleaning system according to the invention.

FIG. 16 shows a sixteenth example embodiment of a cleaning system 8*p* according to the invention. The cleaning system 8*p* includes an attachable dispenser 10*p* having a fluid container 11*p* and a body 12*p* that has connection means, such as a threaded closure 14*p*, to connect the body 12*p* to the container 11*p*. The attachable dispenser 10*p* includes a sprayer mechanism formed within the body 12*p*. The dispenser 10*p* also includes a cylindrical dip tube for transferring fluid to the sprayer mechanism from the container 11*p* as in the dispenser 10 of FIG. 1. The dispenser 10*p* includes a finger operated trigger 28*p* to draw liquid into the sprayer mechanism and then expel liquid from a circular discharge orifice in a nozzle cap 31*p* as in the dispenser 10 of FIG. 1. The closure 14*p* has an attached bracket 17*p* with a downwardly extending pin 19*p*.

Still referring to FIG. 16, the cleaning system 8*p* includes a cleaning implement (similar to cleaning implement 40*a* of FIG. 1D) having an elongated cylindrical handle 42*p* and a mop head with a removable cleaning pad. A support 50*p* is attached to and surrounds the handle 42*p*. The support 50*p* has a section 52*p* that extends away from the handle 42*p*. The section 52*p* includes an opening 59*p*.

The attachable dispenser 10*p* of the cleaning system 8*p* is attached to the handle 42*p* of the cleaning implement as follows. The pin 19*p* of the bracket 17*p* of the closure 14*p* is placed in the opening 59*p* of the support 50*p*. A user can then clean a floor 78*a* (as shown in FIG. 1D) with the attachable dispenser 10*p* securely attached to the handle 42*p* of the cleaning implement. When an occasion arises in which the user wishes to spray fluid from the fluid container 11*p* onto the floor, the user can pull the attachable dispenser 10*p* off of the support 50*p*. After spraying fluid on the floor, the attachable dispenser 10*p* can be reattached to the handle 42*p* as described above.

Figure 17C:
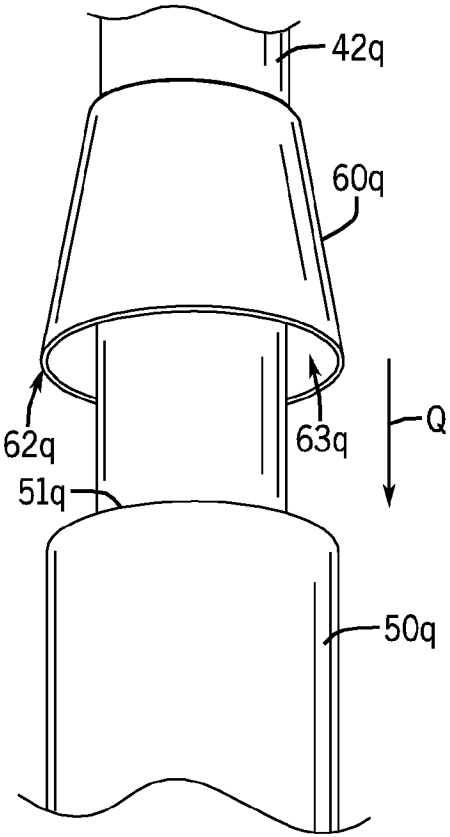
FIGS. 17A to 17C show a seventeenth embodiment of a cleaning system according to the invention with FIG. 17A being a side view of the dispenser of this cleaning system, FIG. 17B being a rear partial perspective view of the dispenser of this cleaning system, and FIG. 17C being a partial perspective view of the handle of this cleaning system.
Figure 17B:
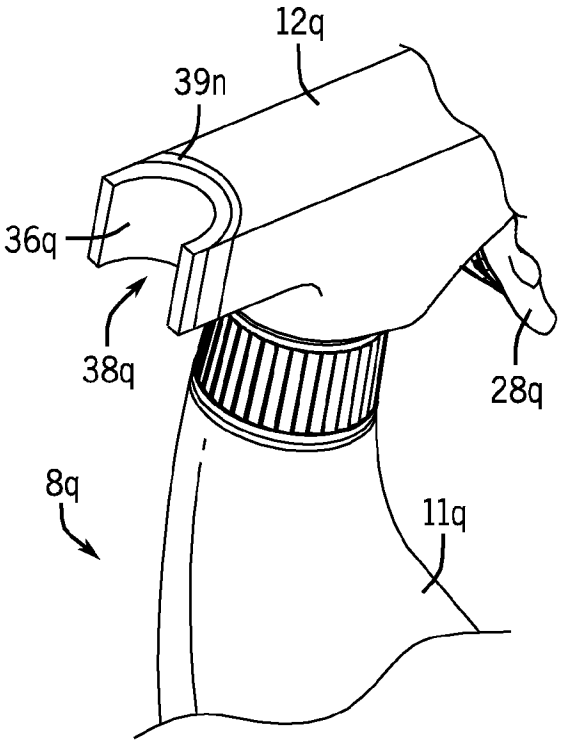
Figure 17A:
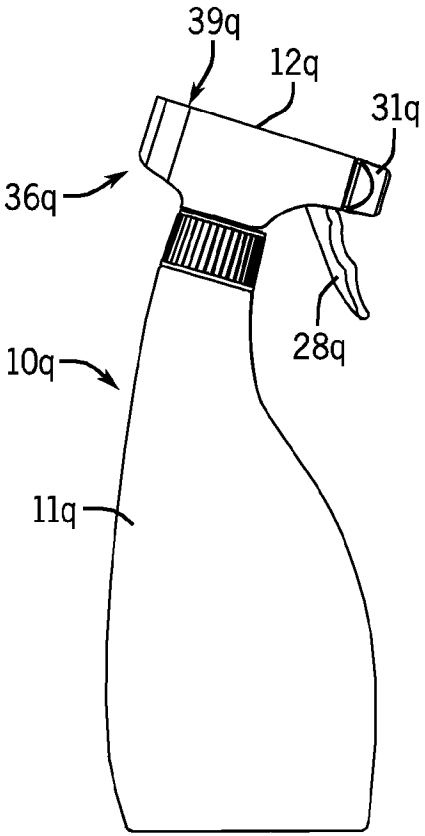

FIGS. 17A to 17C show a seventeenth example embodiment of a cleaning system 8*q* according to the invention. The cleaning system 8*q* includes an attachable dispenser 10*q* having a fluid container 11*q* and a body 12*q* that has connection means to connect the body 12*q* to the container 11*q*. The attachable dispenser 10*q* includes a sprayer mechanism formed within the body 12*q*. The dispenser 10*q* also includes a cylindrical dip tube for transferring fluid to the sprayer mechanism from the container 11*q* as in the dispenser 10 of FIG. 1. The dispenser 10*q* includes a finger operated trigger 28*q* to draw liquid into the sprayer mechanism and then expel liquid from a circular discharge orifice in a nozzle cap 31*q* as in the dispenser 10 of FIG. 1. A U-shaped projection 36*q* extends outward from the body 12*q* at an end portion of the body 12*q* opposite the nozzle cap 31*q*. The body 12*q* has an annular recess 39*n* around its perimeter between the projection 36*q* and the remainder of the body 12*q*.

Still referring to FIGS. 17A to 17C, the cleaning system 8*q* includes a cleaning implement (similar to cleaning implement 40*a* of FIG. 1D) having an elongated cylindrical handle 42*q* and a mop head with a removable cleaning pad. A tubular first support 50*q* is attached to and surrounds the handle 42*q*.

A second support 60*a* is also attached to and surrounds the handle 42*a*. The second support 60*q* is spaced above the first support 50*q*. The second support 60*q* has a flange 62*q* that extends downward and away from the handle 42*q* thereby creating a space 63*q* between the flange 62*q* and the handle 42*q*.

The attachable dispenser 10*q* of the cleaning system 8*q* is attached to the handle 42*q* of the cleaning implement as follows. The projection 36*q* of the body 12*q* of the attachable dispenser 10*q* is placed in the space 63*q* between the section 62*q* and the handle 42*q* such that the recess 39*n* contacts the flange 62*q* of the second support 60*q*. The user moves the second support 60*q* down in direction Q so that the bottom edge 38*q* of the projection 36*q* is forced against the top edge 51*q* of the first support 50*q* thereby securing the body 12*q* of the attachable dispenser 10*q* between the first support 50*q* and the second support 60*q*. A user can then clean a floor 78*a* (as shown in FIG. 1D) with the attachable dispenser 10*q* securely attached to the handle 42*q* of the cleaning implement. When an occasion arises in which the user wishes to spray fluid from the fluid container 11*q* onto the floor, the user can pull the second support 60*q* up in a direction opposite direction Q and remove the attachable dispenser 10*q* from the handle 42*q*. After spraying fluid on the floor, the attachable dispenser 10*q* can be reattached to the handle 42*q* as described above.

Figure 18B:
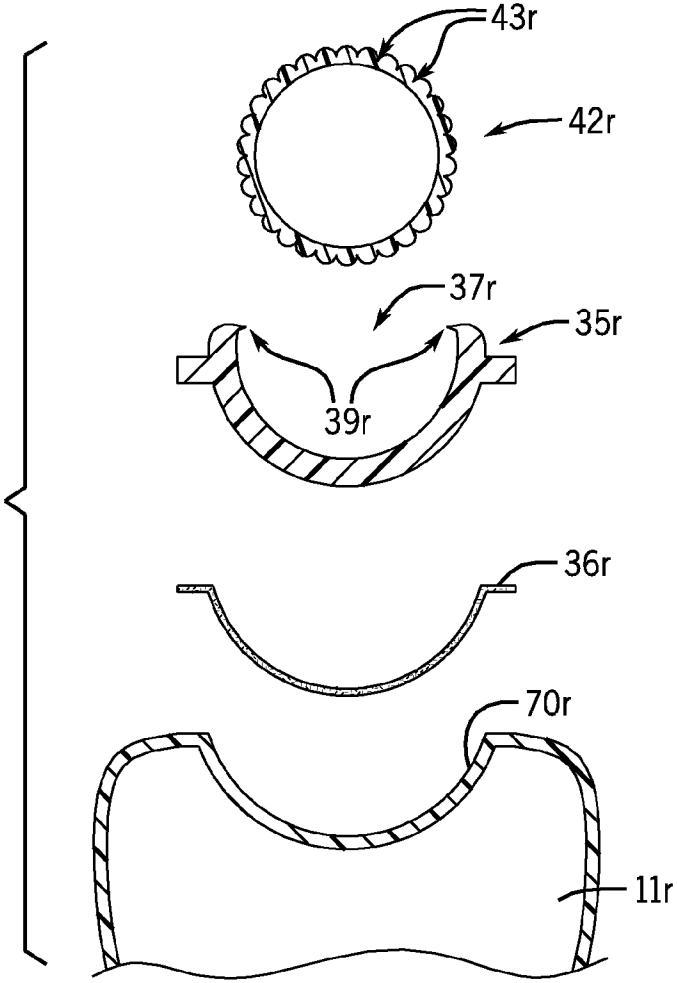
FIGS. 18A and 18B show an eighteenth embodiment of a cleaning system according to the invention with FIG. 18A being a rear partial perspective view of the dispenser attached to the handle support of the cleaning implement of this cleaning system, and FIG. 18B being an exploded cross-sectional view of this cleaning system taken along line 18B-18B of FIG. 18A.
Figure 18A:
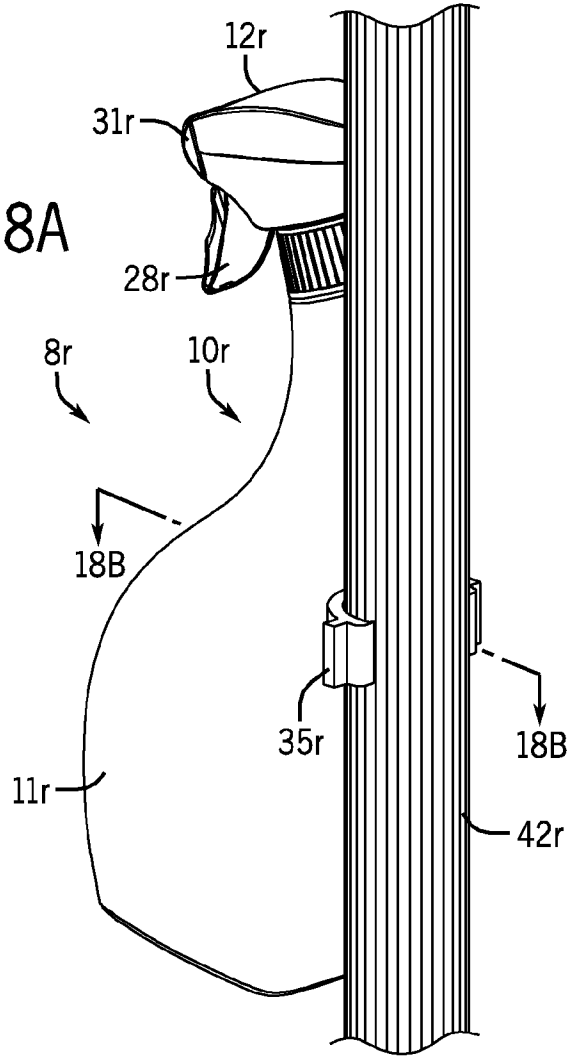

FIGS. 18A and 18B show an eighteenth example embodiment of a cleaning system 8*r* according to the invention. The cleaning system 8*r* includes an attachable dispenser 10*r* having a fluid container 11*r* and a body 12*r* that has connection means to connect the body 12*r* to the container 11*r*. The attachable dispenser 10*r* includes a sprayer mechanism formed within the body 12*r*. The dispenser 10*r* also includes a cylindrical dip tube for transferring fluid to the sprayer mechanism from the container 11*r* as in the dispenser 10 of FIG. 1. The dispenser 10*r* includes a finger operated trigger 28*r* to draw liquid into the sprayer mechanism and then expel liquid from a circular discharge orifice in a nozzle cap 31*r* as in the dispenser 10 of FIG. 1. A bracket 35*r* is connected to the side wall 70*r* of the fluid container 11*r* by an adhesive 36*r*. The bracket 35*r* has an inwardly directed recess 37*r* in the side portion.

Still referring to FIGS. 18A and 18B, the cleaning system 8*r* includes a cleaning implement (similar to cleaning implement 40*a* of FIG. 1D) having an elongated cylindrical handle 42*r* and a mop head with a removable cleaning pad. The handle 42*r* has longitudinal grooves 43*r* in its outer surface.

The attachable dispenser 10*r* of the cleaning system 8*r* is attached to the handle 42*r* of a cleaning implement as follows. The recess 37*r* of the bracket 35*r* of the attachable dispenser 10*r* is snapped over the handle 42*r* to create a friction fit between the bracket 35*r* and the handle 42*r*. Protrusions 39*r* of the bracket 35*r* are seated in the longitudinal grooves 43*r* of the bracket 35*r*. A user can then clean a floor 78*a* (as shown in FIG. 1D) with the attachable dispenser 10*r* securely attached to the handle 42*r* of the cleaning implement. When an occasion arises in which the user wishes to spray fluid from the fluid container 11*r* onto the floor, the user can pull the attachable dispenser 10*r* off of the handle. After spraying fluid on the floor, the attachable dispenser 10*r* can be reattached to the handle as described above.

Figure 19B:
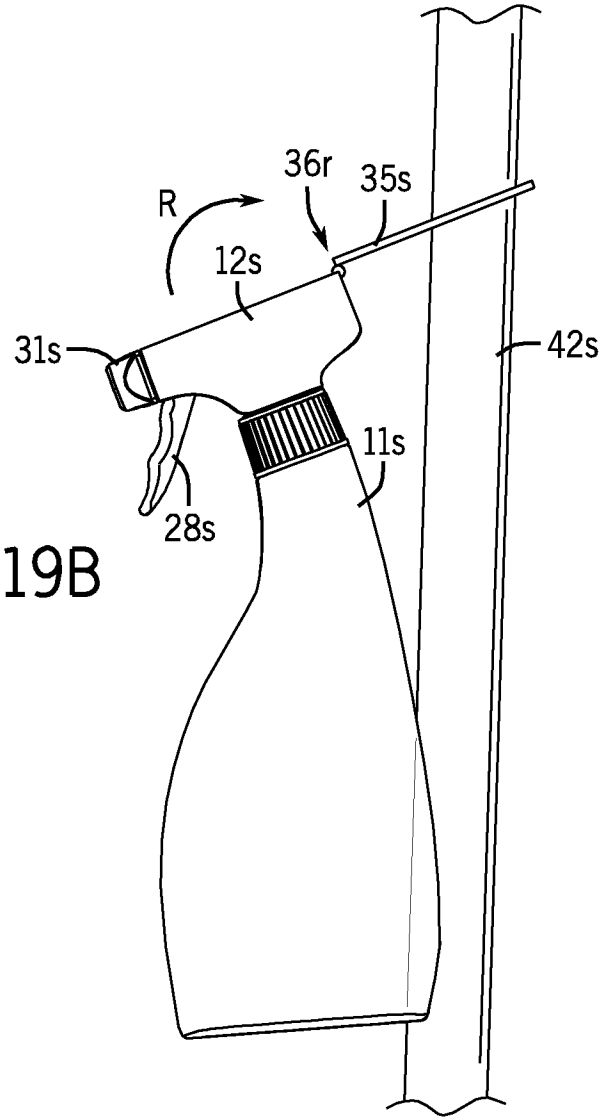
FIGS. 19A and 19B show a nineteenth embodiment of a cleaning system according to the invention with FIG. 19A being a rear partial perspective view of the dispenser of this cleaning system, and FIG. 19B being a partial side view of the dispenser attached to the handle of the cleaning implement of this cleaning system.
Figure 19A:
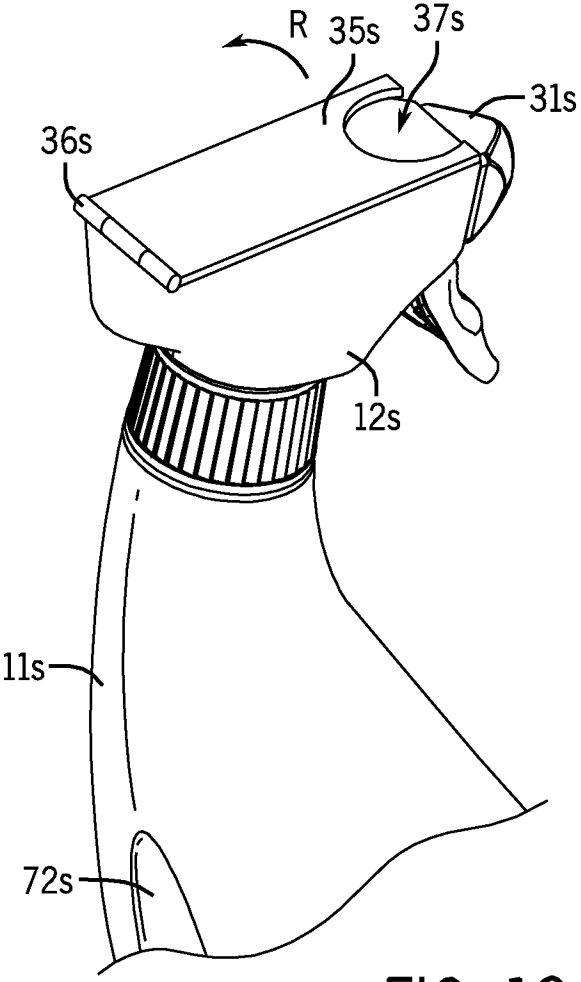

FIGS. 19A and 19B show a nineteenth example embodiment of a cleaning system 8*s* according to the invention. The cleaning system 8*s* includes an attachable dispenser 10*s* having a fluid container 11*s* and a body 12*s* that has connection means to connect the body 12*s* to the container 11*s*. The attachable dispenser 10*s* includes a sprayer mechanism formed within the body 12*s*. The dispenser 10*s* also includes a cylindrical dip tube for transferring fluid to the sprayer mechanism from the container 11*s* as in the dispenser 10 of FIG. 1. The dispenser 10*s* includes a finger operated trigger 28*s* to draw liquid into the sprayer mechanism and then expel liquid from a circular discharge orifice in a nozzle cap 31*s* as in the dispenser 10 of FIG. 1. A support 35*s* is connected to the rear portion of the body 12*s* by a hinge 36*s*. The support 35*s* has an inwardly directed recess 37*s* in its end portion opposite the hinge 36*s*.

Still referring to FIGS. 19A and 19B, the cleaning system 8*s* includes a cleaning implement (similar to cleaning implement 40*a* of FIG. 1D) having an elongated cylindrical handle 42*s* and a mop head with a removable cleaning pad.

The attachable dispenser 10*s* of the cleaning system 8*s* is attached to the handle 42*s* of a cleaning implement as follows. The support 35*s* of the body 12*s* is rotated in direction R from its storage position shown in FIG. 19A to a second position shown in FIG. 19B. The indentation 72*s* of the container 11*s* is aligned with the handle 42*s*. The recess 37*s* of the support 35*s* of the attachable dispenser 10*s* is then snapped over the handle 42*s* to create a friction fit between the support 35*s* and the handle 42*s*. The indentation 72*s* prevents side to side movement of the attachable dispenser 10*s* when cleaning a floor. A user can then clean a floor 78*a* (as shown in FIG. 1D) with the attachable dispenser 10*s* securely attached to the handle 42*s* of the cleaning implement. When an occasion arises in which the user wishes to spray fluid from the fluid container 11*s* onto the floor, the user can pull the attachable dispenser 10*s* off of the handle. After spraying fluid on the floor, the attachable dispenser 10*s* can be reattached to the handle as described above.

FIGS. 20A to 20D show a twentieth example embodiment of a cleaning system 8*t* according to the invention. The cleaning system 8*t* includes an attachable dispenser 10*t* having a fluid container 11*t* and a body 12*t* that has connection means to connect the body 12*t* to the container 11*t*. The attachable dispenser 10*t* includes a sprayer mechanism 13*t* formed within the body 12*t*. The dispenser 10*t* also includes a cylindrical dip tube for transferring fluid to the sprayer mechanism 13*t* from the container 11*t* as in the dispenser 10 of FIG. 1. The dispenser 10*t* includes a finger operated trigger 28*t* to draw liquid into the sprayer mechanism and then expel liquid from a circular discharge orifice in a nozzle cap 31*t* as in the dispenser 10 of FIG. 1. A projecting flange 36*t* extends outward from the nozzle cap 31*t*. The fluid container 11*t* has a side wall 70*t* with an indentation 72*t*. The fluid container 11*t* has a bottom wall 74*t* having an inwardly directed arcuate recess 75*t* that terminates in an inner bottom edge 76*t* and an outer bottom edge 77*t*.

Still referring to FIGS. 20A to 20D, the cleaning system 8*t* includes a cleaning implement 40*t* having an elongated cylindrical handle 42*t* and a mop head 44*t* with a removable cleaning pad 45*t*. A first support 50*t* is attached to and surrounds the handle 42*t*. The support 50*t* has a circumferential section 52*t* that extends upward and away from the handle 42*t* thereby creating an annular space 53*t* between the section 52*t* and the handle 42*t*. A spring 54*t* that is secured to the handle 42*t* biases the first support 50*t* in direction T shown in FIG. 20C. A second support 60*t* is also attached to and surrounds the handle 42*t*. The second support 60*t* is spaced above the first support 50*t*. The second support 60*t* has a flange 62*t* that extends downward and away from the handle 42*t* thereby creating a space 63*t* between the flange 62*t* and the handle 42*t*.

Figure 20A:
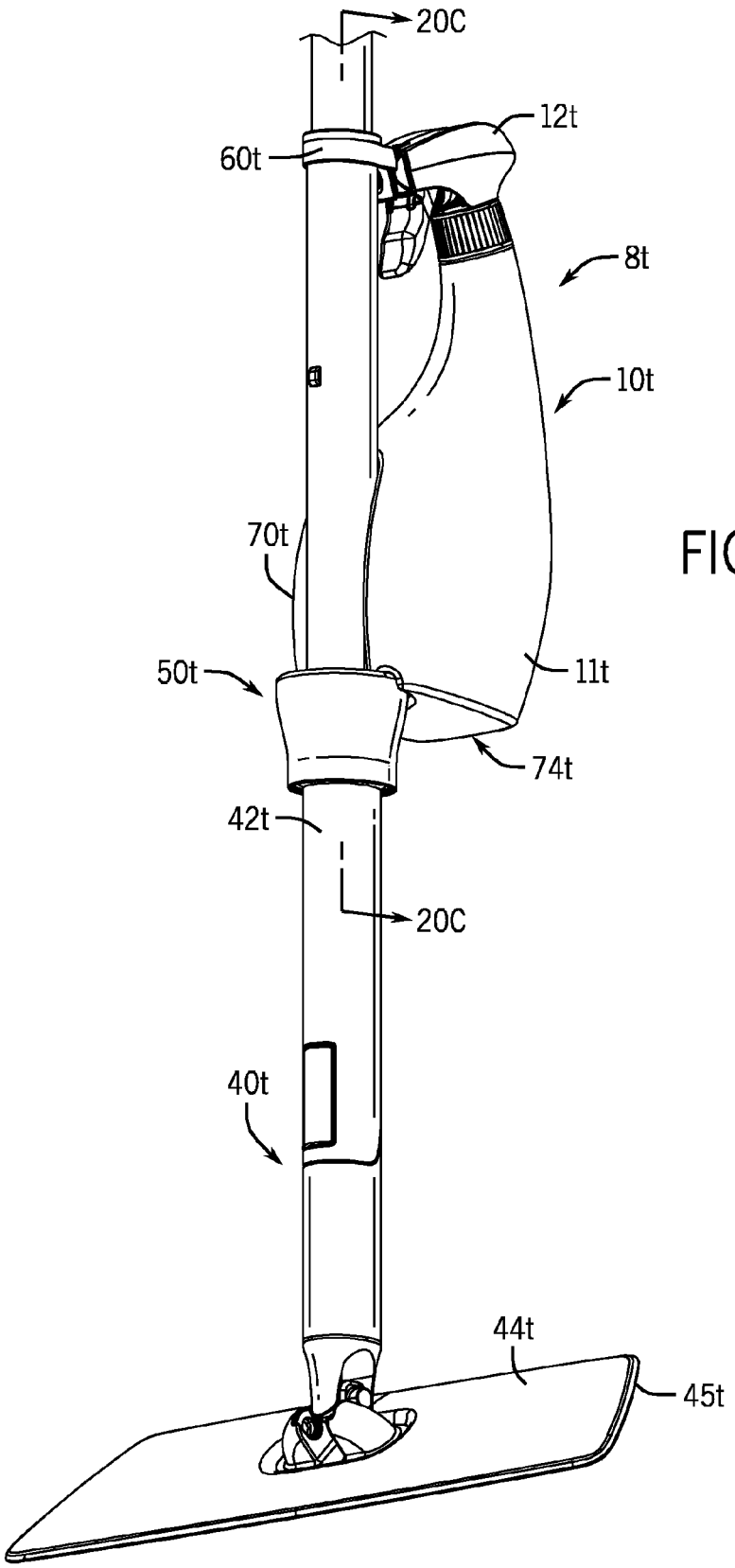
FIGS. 20A to 20D show a twentieth embodiment of a cleaning system according to the invention with FIG. 20A being a front partial perspective view of the dispenser attached to the handle of the cleaning implement of this cleaning system, FIG. 20B being a bottom partial perspective view of the dispenser attached to the handle of the cleaning implement of this cleaning system, FIG. 20C being a cross-sectional view of this cleaning system taken along line 20C-20C of FIG. 20A, and FIG. 20D being a left partial perspective view of the dispenser attached to the handle of the cleaning implement of this cleaning system.
Figure 20B:
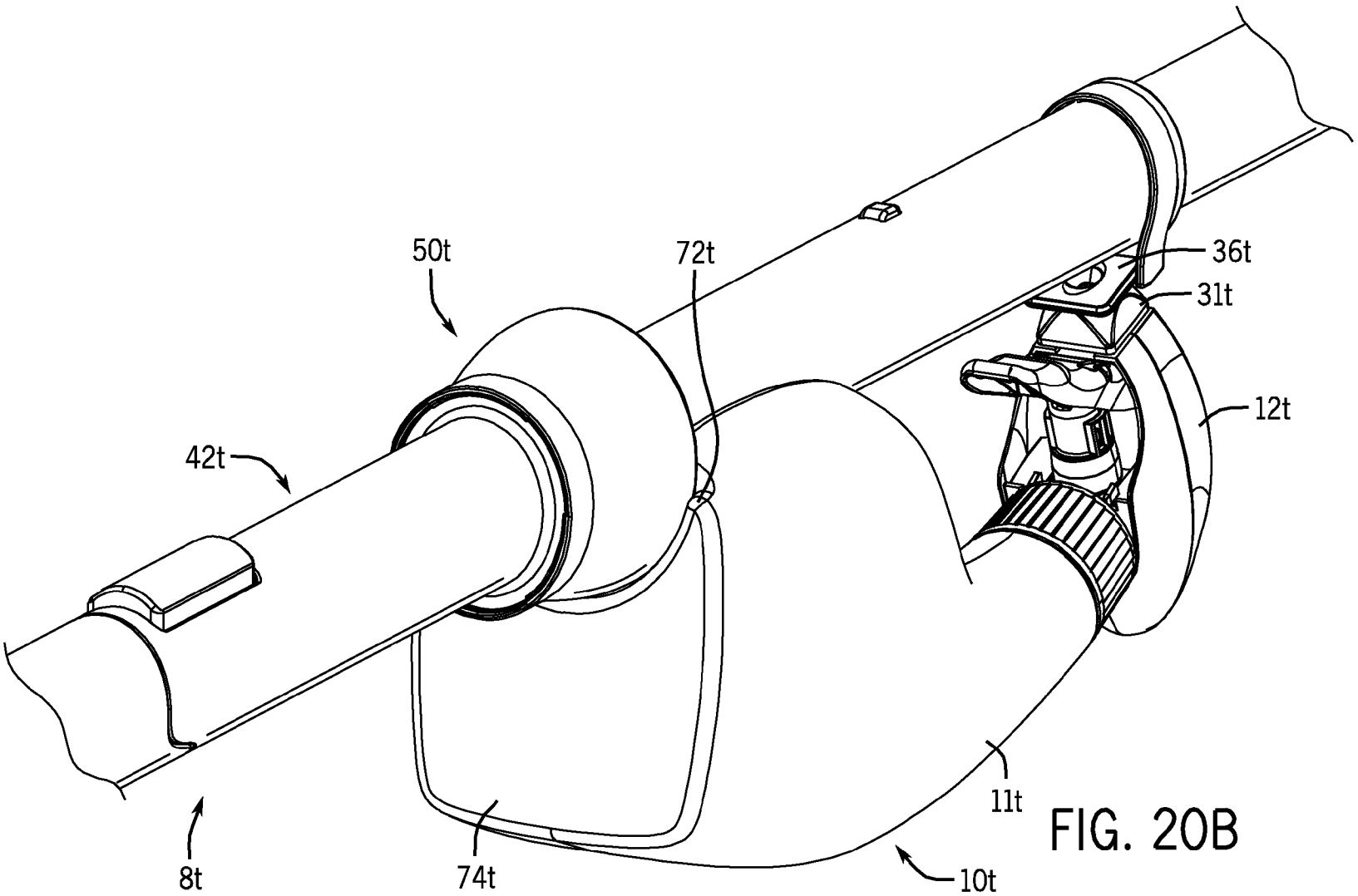
Figure 20C:
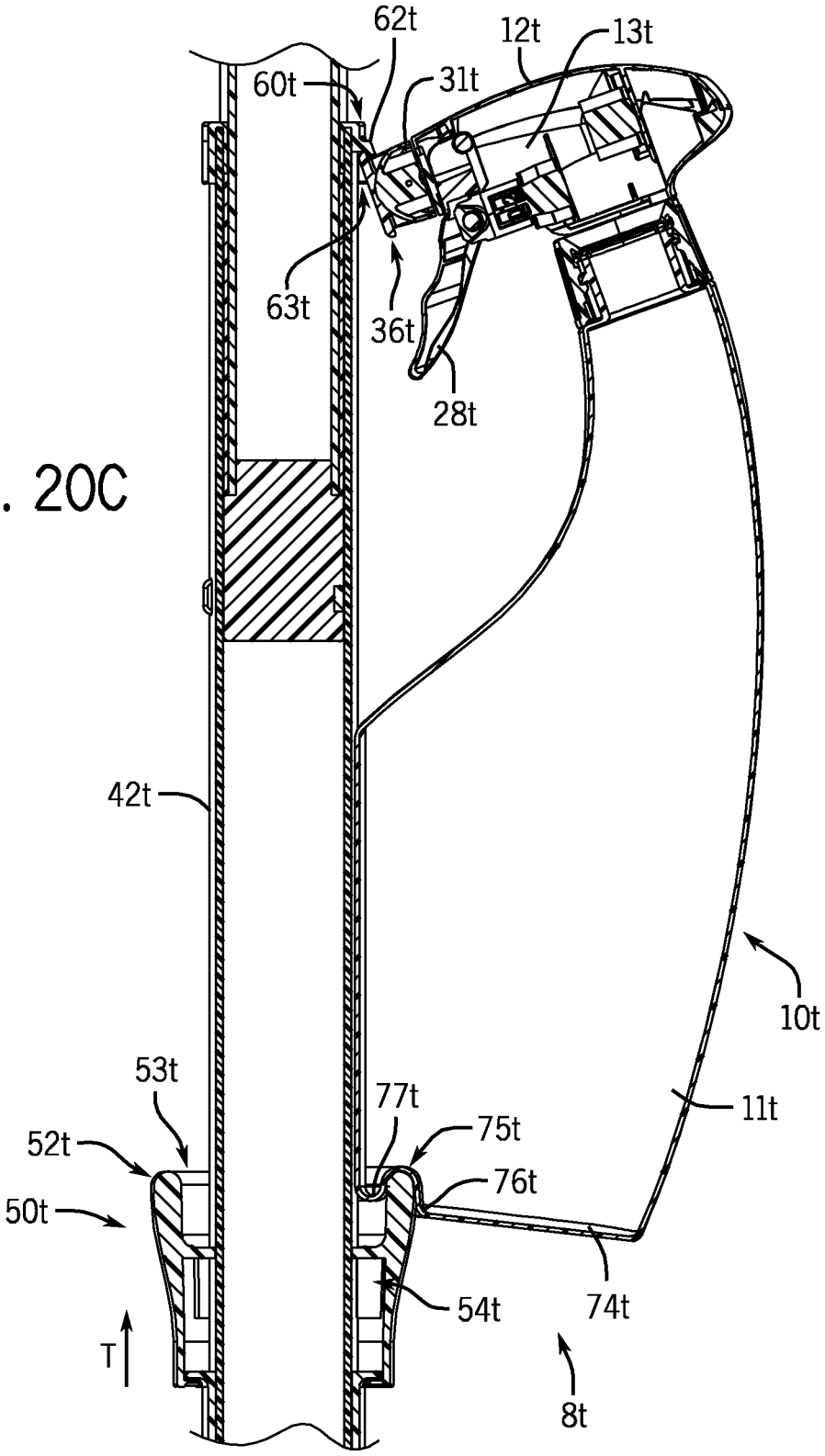
Figure 20D:
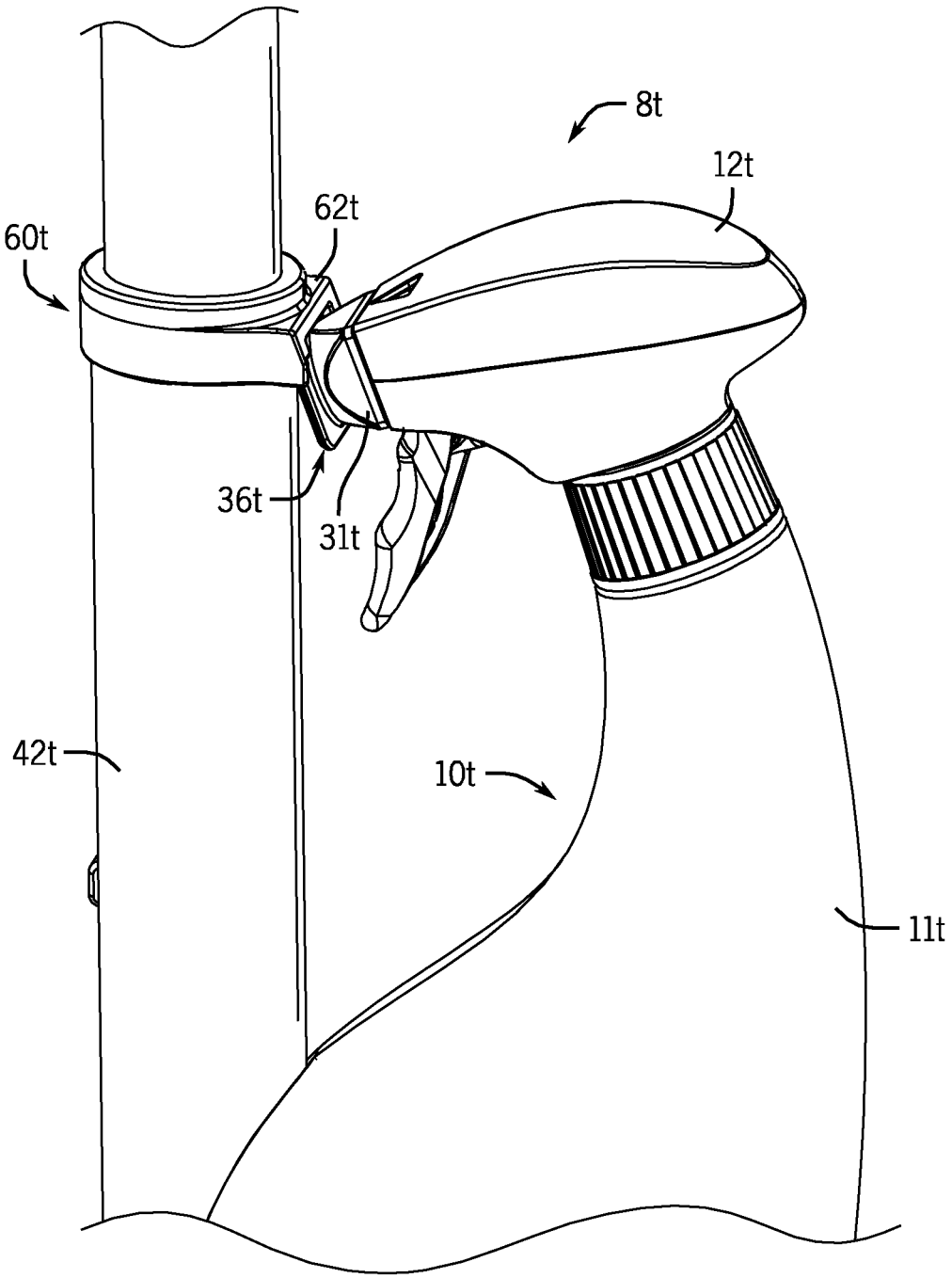

The attachable dispenser 10*t* of the cleaning system 8*t* is attached to the handle 42*t* of the cleaning implement 40*t* as follows. First, the outer bottom edge 77*t* of the recess 75*t* of the fluid container 11*t* is placed in the space 53*t* between the section 52*t* and the handle 42*t* such that the section 52*t* of the first support 50*t* is located in the recess 75*t* of the fluid container 11*t* and the inner bottom edge 76*t* of the recess 75*t* is outside the section 52*t* of the first support 50*t*. The indentation 72*t* is also aligned with the handle 42*t*. The attachable dispenser 10*t* is then moved in a direction that is opposite direction T in FIG. 20C to overcome the biasing force of the spring 54*t* and move the first support 50*t* in a direction that is opposite direction T in FIG. 20C. The user can then position the flange 36*t* of the body 12*t* under the flange 62*t* of the second support 60*t* as shown in FIG. 20D. When a user lets go of the attachable dispenser 10*t*, the biasing force of the spring 54*t* moves the first support 50*t* in direction T in FIG. 20C. This keeps the flange 36*t* of the body 12*t* under the flange 62*t* of the second support 60*t* as shown in FIG. 20D and the attachable dispenser 10*t* is immobilized between the first support 50*t* and the second support 60*t*. A user can then clean a floor as shown in FIG. 1D with the attachable dispenser 10*t* securely attached to the handle 42*t* of the cleaning implement 40*t*. When an occasion arises in which the user wishes to spray fluid from the fluid container 11*t* onto the floor, the user can push down on the attachable dispenser 10*t* in a direction that is opposite to direction T to overcome the biasing force of the spring 54*t* such that the projection 36*t* of the body 12*t* disengages from the flange 62*t* of the second support 60*t*. After spraying fluid on the floor, the attachable dispenser 10*t* can be reattached to the handle 42*t* as described above.

Figure 21A:
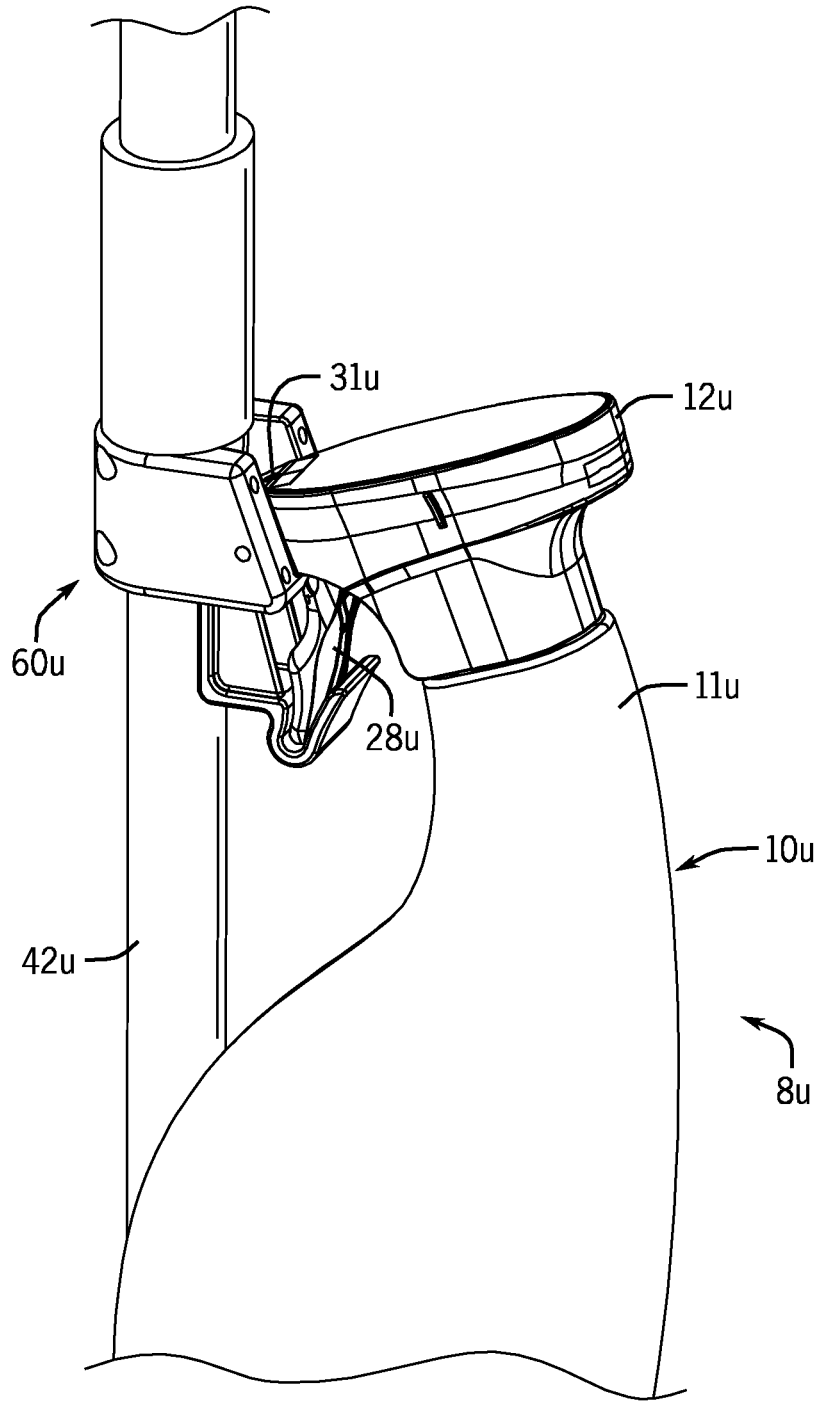
FIGS. 21A and 21B show a twenty-first embodiment of a cleaning system according to the invention with FIG. 21A being a left partial perspective view of the dispenser attached to the handle of the cleaning implement of this cleaning system, and FIG. 21B being a left partial perspective view, similar to FIG. 21A, of the handle of the cleaning implement of this cleaning system, with all but the nozzle cap of the dispenser removed from the view.
Figure 21B:
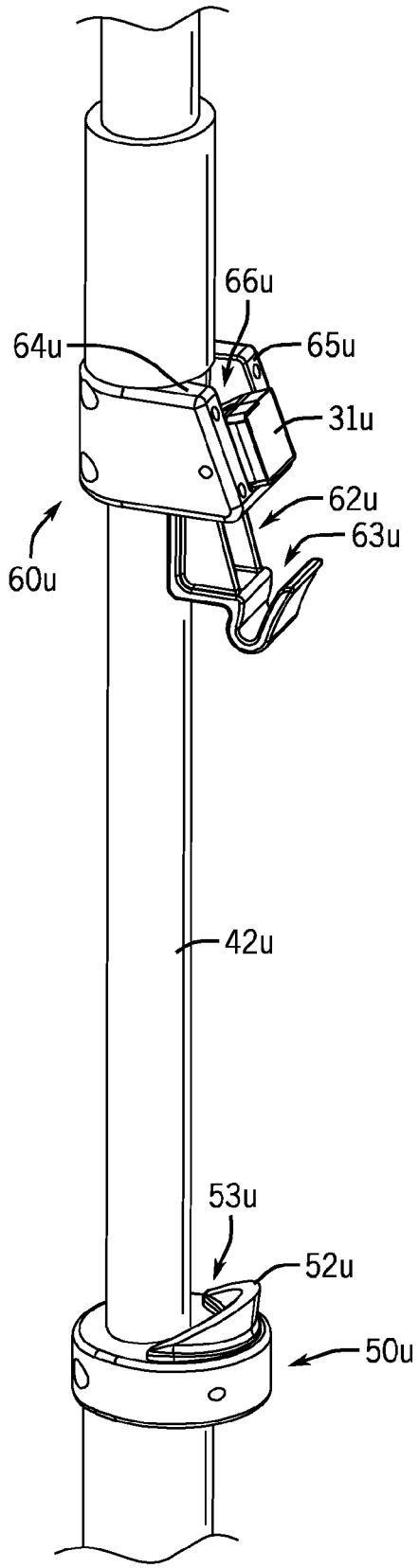

FIGS. 21A and 21B show a twenty-first example embodiment of a cleaning system 8*u* according to the invention. The cleaning system 8*u* includes an attachable dispenser 10*u* having a fluid container 11*u* and a body 12*u* that has connection means to connect the body 12*u* to the container 11*u*. The attachable dispenser 10*u* includes a sprayer mechanism formed within the body 12*u*. The dispenser 10*u* also includes a cylindrical dip tube for transferring fluid to the sprayer mechanism from the container 11*u* as in the dispenser 10 of FIG. 1. The dispenser 10*u* includes a finger operated trigger 28*u* to draw liquid into the sprayer mechanism and then expel liquid from a circular discharge orifice in a nozzle cap 31*u* as in the dispenser 10 of FIG. 1. The fluid container 11*u* has a side wall with an indentation similar to indentation 72*a* of the embodiment of FIG. 1A. The fluid container 11*u* has a bottom wall having an inwardly directed arcuate recess that terminates in an inner bottom edge and an outer bottom edge as in the embodiment of FIG. 1A.

Still referring to FIGS. 21A and 21B, the cleaning system 8*u* includes a cleaning implement (similar to cleaning implement 40*a* of FIG. 1D) having an elongated cylindrical handle 42*u* and a mop head with a removable cleaning pad. A first support 50*u* is attached to and surrounds the handle 42*h*. The first support 50*u* has a section 52*u* spaced away from the handle 42*u* to create a space 53*u* between the section 52*u* and the handle 42*u*. A second support 60*u* is also attached to and surrounds the handle 42*u*. The second support 60*u* is spaced above the first support 50*u*. The second support 60*u* has a bracket 62*u* that extends downward and away from the handle 42*u*. The bracket 62*u* has an upwardly opening channel 63*u* for receiving an end of the trigger 28*u* as shown in FIG. 21A. The support 60*u* also includes spaced apart walls 64*u*, 65*u* that define a space 66*u* for receiving the nozzle cap 31*u* of the body 12*u* as shown in FIG. 21B (wherein all but the nozzle cap 31*u* of the dispenser 10*u* are not shown in the view).

The attachable dispenser 10*u* of the cleaning system 8*u* is attached to the handle 42*u* of the cleaning implement as follows. The indentation is aligned with the handle 42*u* (as in FIG. 1E). The trigger 28*u* of the body 12*u* of the attachable dispenser 10*u* is placed in the channel 63*u* of the support 60*u*. The nozzle cap 31*u* is positioned in the space 66*u* of the support 60*u*. The outer bottom edge of the recess of the fluid container 11*u* is placed in the space 53*u* between the section 52*u* and the handle 42*u* such that the section 52*u* of the first support 50*u* is located in the recess of the fluid container 11*u* and the inner bottom edge of the recess is outside the section 52*u* of the first support 50*u*. A user can then clean a floor 78*a* (as shown in FIG. 1D) with the attachable dispenser 10*u* securely attached to the handle 42*u* of the cleaning implement. The indentation prevents side to side movement of the attachable dispenser 10*u* when cleaning a floor. When an occasion arises in which the user wishes to spray fluid from the fluid container 11*u* onto the floor, the user can pull the attachable dispenser 10*u* off of the supports 50*u* and 60*u*. After spraying fluid on the floor, the attachable dispenser 10*u* can be reattached to the handle 42*u* as described above.

Figure 22:
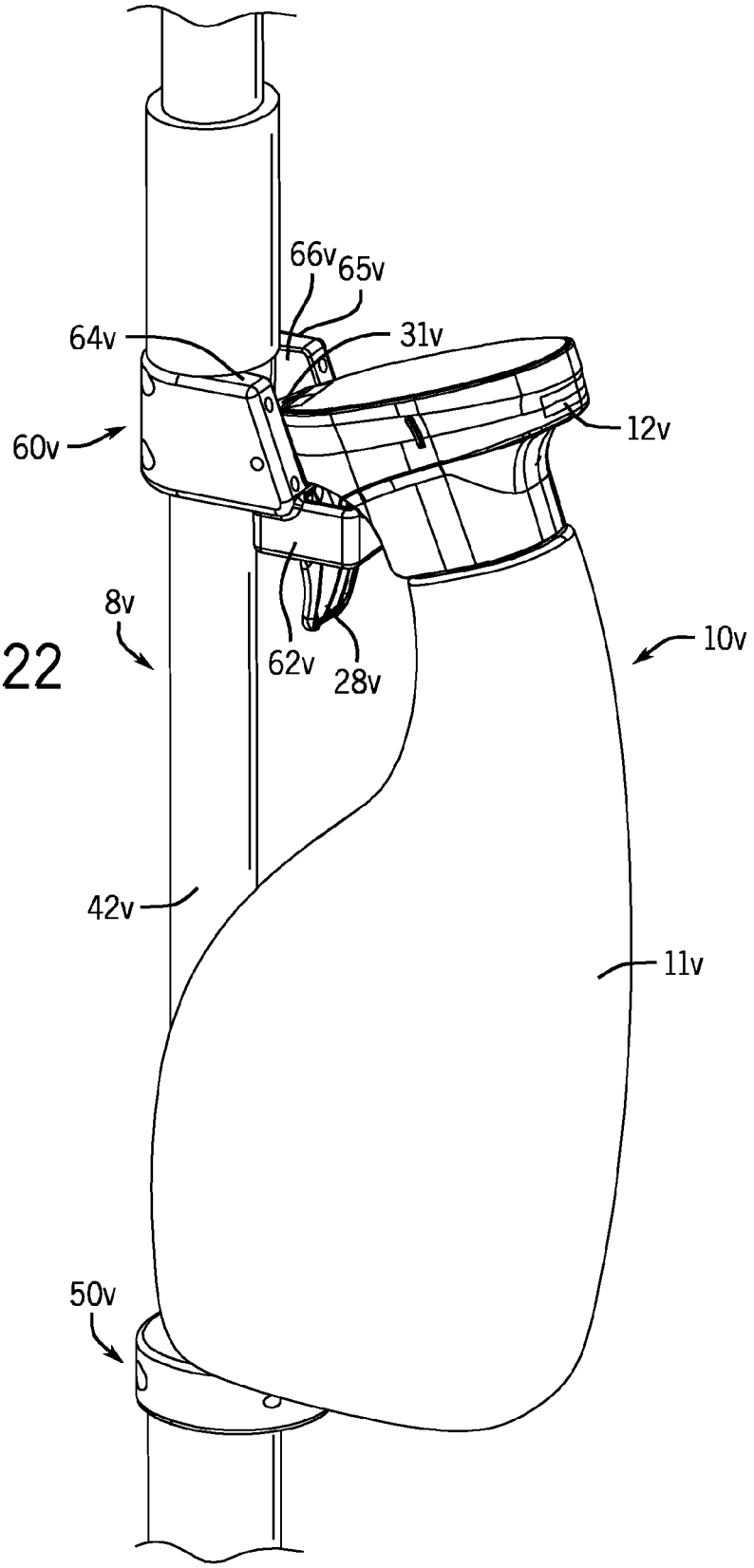
FIG. 22 shows a left partial perspective view of the dispenser attached to the handle of the cleaning implement of a twenty-second embodiment of a cleaning system according to the invention.

FIG. 22 shows a twenty-second example embodiment of a cleaning system 8*v* according to the invention. The cleaning system 8*v* includes an attachable dispenser 10*v* having a fluid container 11*v* and a body 12*v* that has connection means to connect the body 12*v* to the container 11*v*. The attachable dispenser 10*v* includes a sprayer mechanism formed within the body 12*v*. The dispenser 10*v* also includes a cylindrical dip tube for transferring fluid to the sprayer mechanism from the container 11*v* as in the dispenser 10 of FIG. 1. The dispenser 10*v* includes a finger operated trigger 28*v* to draw liquid into the sprayer mechanism and then expel liquid from a circular discharge orifice in a nozzle cap 31*v* as in the dispenser 10 of FIG. 1. The fluid container 11*v* has a side wall with an indentation similar to indentation 72*a* of the embodiment of FIG. 1A. The fluid container 11*v* has a bottom wall having an inwardly directed arcuate recess that terminates in an inner bottom edge and an outer bottom edge as in the embodiment of FIG. 1A.

Still referring to FIG. 22, the cleaning system 8*v* includes a cleaning implement (similar to cleaning implement 40*a* of FIG. 1D) having an elongated cylindrical handle 42*v* and a mop head with a removable cleaning pad. A first support 50*v* is attached to and surrounds the handle 42*v*. The first support 50*v* has a section paced away from the handle 42*v* to create a space between the section and the handle 42*v* as in the embodiment of FIG. 21B. A second support 60*v* is also attached to and surrounds the handle 42*v*. The second support 60*v* is spaced above the first support 50*v*. The second support 60*v* has a lower rectangular wall 62*v* that defines an opening for receiving the trigger 28*v* as shown in FIG. 22. The support 60*v* also includes spaced apart walls 64*v*, 65*v* that define a space 66*v* for receiving the nozzle cap 31*v* of the body 12*v* as shown in FIG. 22.

The attachable dispenser 10*v* of the cleaning system 8*v* is attached to the handle 42*v* of the cleaning implement as follows. The indentation is aligned with the handle 42*v* (as in FIG. 1E). The trigger 28*v* of the body 12*v* of the attachable dispenser 10*v* is placed in the opening defined by the wall 62*v* of the support 60*v*. The nozzle cap 31*v* is positioned in the space 66*v* of the support 60*v*. The outer bottom edge of the recess of the fluid container 11*v* is placed in the space between the section and the handle 42*v* such that the section of the first support 50*v* is located in the recess of the fluid container 11*v* and the inner bottom edge of the recess is outside the section of the first support 50*v*. A user can then clean a floor 78*a* (as shown in FIG. 1D) with the attachable dispenser 10*v* securely attached to the handle 42*v* of the cleaning implement. The indentation prevents side to side movement of the attachable dispenser 10*v* when cleaning a floor. When an occasion arises in which the user wishes to spray fluid from the fluid container 11*v* onto the floor, the user can pull the attachable dispenser

10*v* off of the supports 50*v* and 60*v*. After spraying fluid on the floor, the attachable dispenser 10*v* can be reattached to the handle 42*v* as described above.

Figure 23:
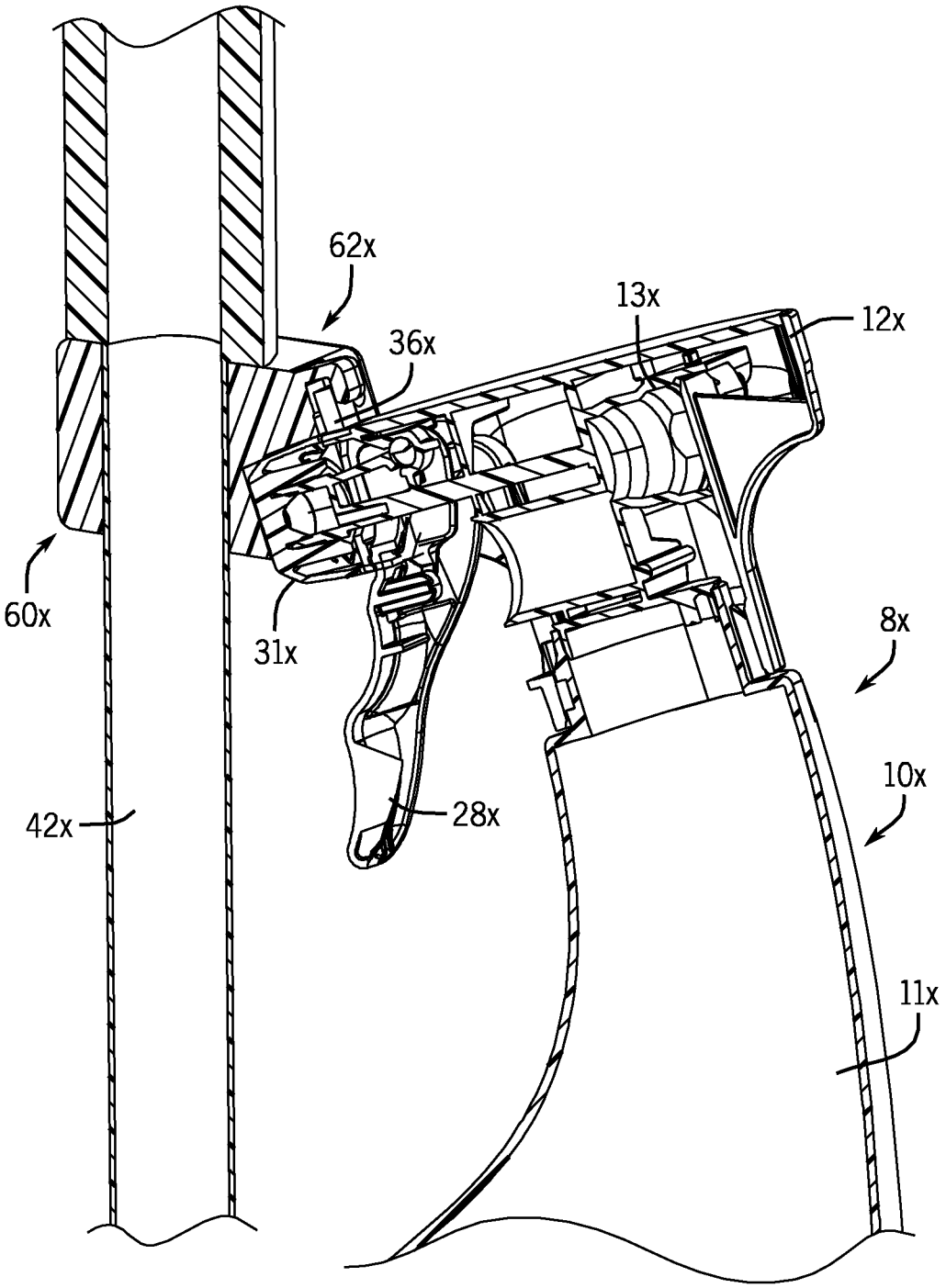
FIG. 23 shows a left partial perspective view of the dispenser attached to the handle of the cleaning implement of a twenty-third embodiment of a cleaning system according to the invention.

FIG. 23 shows a twenty-third example embodiment of a cleaning system 8*x* according to the invention. The cleaning system 8*x* includes an attachable dispenser 10*x* having a fluid container 11*x* and a body 12*x* that has connection means to connect the body 12*x* to the container 11*x*. The attachable dispenser 10*x* includes a sprayer mechanism 13*x* formed within the body 12*x*. The dispenser 10*x* also includes a cylindrical dip tube for transferring fluid to the sprayer mechanism 13*x* from the container 11*x* as in the dispenser 10 of FIG. 1. The dispenser 10*x* includes a finger operated trigger 28*x* to draw liquid into the sprayer mechanism and then expel liquid from a circular discharge orifice in a nozzle cap 31*x* as in the dispenser 10 of FIG. 1. A projection 36*x* extends upward from the nozzle cap 31*x*. The fluid container 11*x* has a side wall with an indentation similar to indentation 72*a* of the embodiment of FIG. 1A. The fluid container 11*x* has a bottom wall having an inwardly directed arcuate recess that terminates in an inner bottom edge and an outer bottom edge as in the embodiment of FIG. 1A.

Still referring to FIG. 23, the cleaning system 8*x* includes a cleaning implement (similar to cleaning implement 40*a* of FIG. 1D) having an elongated cylindrical handle 42*x* and a mop head with a removable cleaning pad. A first support (similar to support 50*u* in FIG. 21B) is attached to and surrounds the handle 42*x*. A second support 60*x* is also attached to and surrounds the handle 42*x*. The second support 60*x* is spaced above the first support. The second support 60*x* has a flange 62*x* that extends away from the handle 42*x* thereby creating a space between the flange 62*x* and the handle 42*x*.

The attachable dispenser 10*x* of the cleaning system 8*x* is attached to the handle 42*x* as follows. First, the section of the first support is located in the recess of the fluid container 11*x*. The indentation is also aligned with the handle 42*x*. The attachable dispenser 10*x* is then moved until the projection 36*x* of the nozzle cap 31*x* of the body 12*x* is snapped under the flange 62*x* of the second support 60*x* as shown in FIG. 23. A user can then clean a floor 78*a* as shown in FIG. 1D with the attachable dispenser 10*x* securely attached to the handle 42*x* of the cleaning implement 40*x*. When an occasion arises in which the user wishes to spray fluid from the fluid container 11*x* onto the floor 78*a*, the user can disengage the projection 36*x* from flange 62*x* of the second support 60*x*. After spraying fluid on the floor, the attachable dispenser 10*x* can be reattached to the handle 42*a* as described above.

Thus, the invention provides cleaning systems with an attachable dispenser that allows the user to attach the dispenser to the handle of a cleaning implement. This keeps within convenient reach of the user the applied fluid product contained in the attachable dispenser. A user does not need to walk or bend over to retrieve the applied product. In some embodiments, the user may be able to dispense the applied product from the attachable dispenser while the dispenser is attached to the handle.

Although the present invention has been described in detail with reference to certain example embodiments, one skilled in the art will appreciate that the present invention can be practiced by other than the described embodiments, which have been presented for purposes of illustration and not of limitation. Therefore, the scope of the invention should not be limited to the description of the embodiments contained herein.

INDUSTRIAL APPLICABILITY

The present invention provides a cleaning system including a cleaning implement having a handle and an attachable fluid dispenser that can be secured to the handle of the cleaning implement.

What is claimed is:

1. A cleaning system comprising:

a cleaning implement including a handle and first and second supports located on each handle, the support having a section that is spaced away from the handle; and an attachable dispenser including a container connected to a body having a dispensing mechanism for delivering a fluid from the container and out of a discharge orifice of the body, the body having a projection dimensioned to engage the section of the first support when the attachable dispenser is attached to the handle, and the container having an inwardly directed recess dimensioned to matingly engage the section of the second support when the attachable dispenser is attached to the handle, wherein the recess of the container is an upwardly directed recess formed in a bottom wall of the container, the recess having a bottom edge concavely shaped about the handle when the attachable dispenser is attached to the handle.

2. The cleaning system of claim 1 wherein:

the projection is located at an end portion of the body adjacent the discharge orifice of the body.

3. The cleaning system of claim 1 wherein:

the projection is located at an end portion of the body opposite the discharge orifice of the body.

4. The cleaning system of claim 1 wherein:

the projection is located on a nozzle cap of the body.

5. The cleaning system of claim 1 wherein:

the projection is a nozzle cap of the body.

6. The cleaning system of claim 5 wherein:

the nozzle cap has an inwardly directed recess dimensioned to matingly engage an edge of a slot of the section of the first support when the attachable dispenser is attached to the handle.

7. The cleaning system of claim 1 wherein:

the projection is a trigger of the dispensing mechanism.

8. The cleaning system of claim 7 wherein:

the trigger has an opening dimensioned to surround the section of the first support when the attachable dispenser is attached to the handle.

9. The cleaning system of claim 1 wherein:

the projection is located on a closure for connecting the container and the body.

10. The cleaning system of claim 1 wherein:

the projection defines an opening in the body, the opening being dimensioned to surround the section of the first support when the attachable dispenser is attached to the handle.

11. A cleaning system comprising:

a cleaning implement including a handle and a support located on the handle, the support having a section that extends away from the handle; and an attachable dispenser including a container connected to a body having a dispensing mechanism for delivering a fluid from the container and out of a discharge orifice of the body, the container having an inwardly directed recess dimensioned to matingly engage the section of the support when the attachable dispenser is attached to the handle, wherein the recess of the container is an upwardly directed recess formed in a bottom wall of the container, the recess having a bottom edge concavely shaped about the handle when the attachable dispenser is attached to the handle.

12. The cleaning system of claim 11 wherein:

the section of the support is arcuate.

13. The cleaning system of claim 11 wherein:

a side wall of the container has an indentation dimensioned to engage the handle adjacent the support.

14. The cleaning system of claim 11 wherein:

the cleaning implement further comprises a second support located on the handle, the second support has a portion that extends away from the handle, and the body has a projection dimensioned to engage the portion of the second support when the attachable dispenser is attached to the handle.

15. The cleaning system of claim 14 wherein:

a spring biases one of the support and the second support toward the other of the first support and the second support.

16. A cleaning system comprising:

a cleaning implement including a handle and a support located on the handle, the support having a section that is spaced away from the handle; and an attachable dispenser including a container connected to a body having a dispensing mechanism for delivering a fluid from the container and out of a discharge orifice of the body, the container having an inwardly directed recess dimensioned to matingly engage the section of the support when the attachable dispenser is attached to the handle, a side wall of the container having an indentation dimensioned to engage the handle when the attachable dispenser is attached to the handle, and the body being dimensioned to engage the section of the support when the attachable dispenser is attached to the handle, and wherein the recess of the container is an upwardly directed recess formed in a bottom wall of the container, the recess having a bottom edge concavely shaped about the handle when the attachable dispenser is attached to the handle.

17. The cleaning system of claim 16 wherein:

the container has an inwardly directed recess dimensioned to matingly engage a section of a second support when the attachable dispenser is attached to the handle.

18. The cleaning system of claim 17 wherein:

the recess is part of a bottom wall of the container.

19. The cleaning system of claim 16 wherein:

a projection from the body engages the section of the support when the attachable dispenser is attached to the handle.

* * * * *